US011279522B2

(12) United States Patent
O'Hara et al.

(10) Patent No.: US 11,279,522 B2
(45) Date of Patent: Mar. 22, 2022

(54) CONTAINER FOR STORAGE AND TRANSPORTATION OF GOODS

(71) Applicant: Softbox Systems Limited, Long Crendon (GB)

(72) Inventors: Padraic Thomas O'Hara, Long Crendon (GB); Baptiste Kuhn, Long Crendon (GB)

(73) Assignee: Softbox Systems Limited, Long Crendon (GB)

( * ) Notice: Subject to any disclaimer, the term of this patent is extended or adjusted under 35 U.S.C. 154(b) by 0 days.

(21) Appl. No.: 17/162,311

(22) Filed: Jan. 29, 2021

(65) Prior Publication Data

US 2021/0139200 A1 May 13, 2021

Related U.S. Application Data

(63) Continuation-in-part of application No. PCT/EP2020/025515, filed on Nov. 13, 2020.
(Continued)

(30) Foreign Application Priority Data

Nov. 13, 2019 (GB) ..... 1916503
Nov. 12, 2020 (GB) ..... 2017874

(51) Int. Cl.
*B65D 30/08* (2006.01)
*B65D 30/20* (2006.01)
(Continued)

(52) U.S. Cl.
CPC ..... *B65D 31/02* (2013.01); *A45C 11/20* (2013.01); *B65D 31/10* (2013.01); *B65D 33/18* (2013.01);
(Continued)

(58) Field of Classification Search
CPC ..... B65D 31/02; B65D 31/10; B65D 31/005; B65D 33/18; B65D 33/1691; B65D 81/18;
(Continued)

(56) References Cited

U.S. PATENT DOCUMENTS 8,557,367 B2 * 10/2013 Netravali ..... B32B 5/026 428/178
9,284,088 B2 * 3/2016 Humphries ..... B65D 81/3862
(Continued)

OTHER PUBLICATIONS https://www.amazon.com/Pack-Insulated-Gusseted-pharmaceuticals-Cosmetics/dp/B07FYDHNBH; "5 Pack Foil Insulated Box Liners 6x6x6 Small Size Thermal Box Liners. Bottom Gusseted Box Liners for Shipping Food, Biotech, Cosmetics. Gusseted Bottom."; Sold by ABC Pack & Supply Inc.

*Primary Examiner* — Emmanuel E Duke
(74) *Attorney, Agent, or Firm* — Galvin Patent Law LLC; Brian R. Galvin; Brian S. Boon

(57) ABSTRACT

A bag or bag-like transport container or delivery container that can provide a high degree of thermal insulation. More particularly, the disclosed invention relates to an improved container for storage and transportation of goods that comprises a bag-like or box-like container that can be hand-held and that can provide good thermal insulation. The disclosed invention seeks to provide an improved corrugated sheet container and provides a system having first and second cellulose fiber bag-like elements, at least one of which is provided with a surface metallization treatment whereby to provide beneficial thermal characteristics.

20 Claims, 24 Drawing Sheets

Related U.S. Application Data

(60) Provisional application No. 63/113,470, filed on Nov. 13, 2020.

(51) Int. Cl.

| | |
|---|---|
| ***B65D 81/18*** | (2006.01) |
| ***B65D 33/18*** | (2006.01) |
| ***A45C 11/20*** | (2006.01) |
| ***F25D 3/08*** | (2006.01) |
| ***B65D 81/38*** | (2006.01) |

(52) U.S. Cl.
CPC ..... *B65D 81/18* (2013.01); *B65D 81/3888* (2013.01); *F25D 3/08* (2013.01)

(58) Field of Classification Search
CPC ..... B65D 81/3888; B65D 81/3897; B65D 81/3823; B65D 65/403; B65D 65/42; B65D 2565/382; B65D 77/04; B65D 3/22; B65D 5/563; A45C 11/20; F25D 3/08; B32B 29/08; B32B 1/02; B32B 27/10; B32B 7/12; B29C 43/34; D21H 19/44; D21H 19/16; B05B 1/34
See application file for complete search history.

(56) References Cited

U.S. PATENT DOCUMENTS

| | | | | |
|---|---|---|---|---|
| 11,137,198 | B2 * | 10/2021 | Waltermire | F25D 23/069 |
| 2007/0151685 | A1 * | 7/2007 | Horsfield | B32B 23/04 162/125 |
| 2008/0164265 | A1 * | 7/2008 | Conforti | B65D 81/3823 220/592.2 |
| 2009/0034883 | A1 * | 2/2009 | Giuliani | B65D 33/02 383/6 |
| 2013/0112695 | A1 * | 5/2013 | Hall | B65D 81/3818 220/592.25 |
| 2017/0320653 | A1 * | 11/2017 | Mogil | B65D 33/24 |
| 2018/0299059 | A1 * | 10/2018 | McGoff | F16L 59/00 |
| 2018/0319569 | A1 * | 11/2018 | McGoff | B65D 81/3897 |
| 2019/0091077 | A1 * | 3/2019 | Cheng | A61F 13/551 |

* cited by examiner

Protection Performance
Data From Worst Performing Product Position – Right Bottle, Product

| | | | | | | | | |
|---|---|---|---|---|---|---|---|---|
| Product Start Temperature 6.1°C | Duration | 1hr | 2hr | 3hr | 4hr | 5hr | 6hr | 7hr |
| | LogTag Temperature (°C) | 4.3 | 2.2 | 0.6 | -0.7 | -1.7 | -2.6 | -3.3 |
| | Change (°C) | 1.8 | 3.9 | 5.5 | 6.8 | 7.8 | 8.7 | 9.4 |

Protection Performance
Data From Position – On Top of Product, Air

| | | | | | | | | |
|---|---|---|---|---|---|---|---|---|
| Product Start Temperature 5.6°C | Duration | 1hr | 2hr | 3hr | 4hr | 5hr | 6hr | 7hr |
| | LogTag Temperature (°C) | -0.9 | -2.4 | -3.5 | -4.3 | -5.0 | -5.6 | -6.1 |
| | Change (°C) | 6.5 | 8.0 | 9.1 | 9.9 | 10.6 | 11.2 | 11.7 |

Protection Performance
Data From Position – On Top of Product, Relative Humidity

| | | | | | | | | |
|---|---|---|---|---|---|---|---|---|
| Product Start Relative Humidity 64.9% | Duration | 1hr | 2hr | 3hr | 4hr | 5hr | 6hr | 7hr |
| | LogTag RH (%) | 60.4 | 58.2 | 56.8 | 55.8 | 55.2 | 54.8 | 54.7 |
| | Change | 4.5 | 6.7 | 8.1 | 9.1 | 9.7 | 10.1 | 10.2 |

Fig. 6B

Protection Performance
Data From Worst Performing Product Position – Right Bottle, Product

| | | | | | | | | |
|---|---|---|---|---|---|---|---|---|
| Product Start Temperature 5.5°C | Duration | 1hr | 2hr | 3hr | 4hr | 5hr | 6hr | 7hr |
| | LogTag Temperature (°C) | 3.1 | 1.0 | -0.8 | -2.2 | -3.3 | -4.1 | -4.9 |
| | Change (°C) | 2.4 | 4.5 | 6.3 | 7.7 | 8.8 | 9.6 | 10.4 |

Protection Performance
Data From Position – On Top of Product, Air

| | | | | | | | | |
|---|---|---|---|---|---|---|---|---|
| Product Start Temperature 5.3°C | Duration | 1hr | 2hr | 3hr | 4hr | 5hr | 6hr | 7hr |
| | LogTag Temperature (°C) | -1.2 | -2.7 | -3.9 | -4.7 | -5.5 | -6.0 | -6.5 |
| | Change (°C) | 6.5 | 8.0 | 9.2 | 10.0 | 10.8 | 11.3 | 11.8 |

Protection Performance
Data From Position – On Top of Product, Relative Humidity

| | | | | | | | | |
|---|---|---|---|---|---|---|---|---|
| Product Start Relative Humidity 84.4% | Duration | 1hr | 2hr | 3hr | 4hr | 5hr | 6hr | 7hr |
| | LogTag RH (%) | 79.5 | 78.8 | 78.9 | 79.6 | 80.4 | 81.2 | 82.0 |
| | Change | 4.9 | 5.6 | 5.5 | 4.8 | 4.0 | 3.2 | 2.4 |

Fig. 7B

| Properties | *Units* | Value |
|---|---|---|
| Material' s conductivity - HOT | $W.m^{-1}.K^{-1}$ | 0.034 |
| Material' s conductivity - COLD | $W.m^{-1}.K^{-1}$ | 0.030 |
| Material thickness | *mm* | 2.5 |
| Reflector thickness | *mm* | 0.12 |
| Gap size L_2 | *mm* | 10 |
| Material spacing between gaps L_1 | *mm* | 5 |
| Reflector' s emissivity | | 0.1 |
| Lower temperature - HOT | °C | 45 |
| Upper temperature - HOT | °C | 20 |
| Lower temperature - COLD | °C | 15 |
| Upper temperature - COLD | °C | -10 |
| Effective thermal conductivity - HOT | $W.m^{-1}.K^{-1}$ | 0.0365 |
| Effective thermal conductivity - COLD | $W.m^{-1}.K^{-1}$ | 0.0361 |

Fig. 8A

Results Density

| Material | Configuration | Width | Length mm | Height | Weight g | Density $kg.m^{-3}$ |
|---|---|---|---|---|---|---|
| Coiled single flute corrugated board | 6 Layers | 203 | 209 | 31.75 | 45.80 | 34.510 |
| Coiled single flute corrugated board | 6 Layers | 204 | 199 | 31.28 | 31.68 | 24.948 |
| perforations (10x10) | 6 Layers with reflectors | 205 | 206 | 33.71 | 77.70 | 54.581 |
| Coiled single flute corrugated board | 6 Layers | | | | 17.48 | |
| perforations (40x40) | 6 Layers with reflectors | 205 | 203 | 32.57 | 63.35 | 31.415 |

Fig. 9

Thermal Conductivity

| | $\lambda_{cold}$ | | $\lambda_{hot}$ | |
|---|---|---|---|---|
| | $W.m^{-1}.K^{-1}$ | | $W.m^{-1}.K^{-1}$ | |
| Thermaflute with reflectors | 0.039442641 | -11.5% | 0.044950854 | -12.1% |
| Thermaflute with reflectors and holes | 0.034910059 | | 0.039519788 | |

Fig. 10

Specific heat capacity

| Material | Configuration | Height /mm | Weight / g | Density / $kg.m^{-3}$ | Specific Heat Capacity Cp $J.K^{-1}.kg^{-1}$ |
|---|---|---|---|---|---|
| Thermaflute | 6 Layers | 20.57 | 46 | 54.4 | 1528 |
| Thermaflute with holes (10x10) | 6 Layers with laminated reflectors | 20.24 | 78 | 93.2 | 1523 |
| Thermaflute with holes (40x40) | 6 Layers with reflectors | 17.07 | 63 | 90.1 | 1564 |

Fig. 11

CONTAINER FOR STORAGE AND TRANSPORTATION OF GOODS

CROSS-REFERENCE TO RELATED APPLICATIONS

| Application No. | Date Filed | Title |
|---|---|---|
| Current application | Herewith | AN IMPROVED CONTAINER FOR STORAGE AND TRANSPORTATION OF GOODS<br>Claims benefit of, and priority to: |
| 63/113,470 | Nov. 13, 2020 | AN INSULATING STORAGE, TRANSPORT AND DELIVERY CONTAINER<br>Is a continuation-in-part of: |
| PCT/EP2020/025515 | Nov. 13, 2020 | AN INSULATING STORAGE, TRANSPORT AND DELIVERY CONTAINER<br>which is a PCT filing of Great Britain application: |
| GB1916503.4 | Nov. 13, 2019 | AN INSULATING STORAGE, TRANSPORT AND DELIVERY CONTAINER<br>and is also a PCT filing of Great Britain application: |
| GB2017874.5 | Nov. 12, 2020 | AN INSULATING STORAGE, TRANSPORT AND DELIVERY CONTAINER |

the entire specification of each of which is incorporated herein by reference.

BACKGROUND

Field of the Art

The present invention relates to the field of the storage and transportation of goods, and in particular, to a bag or bag-like transport container or delivery container that can provide a high degree of thermal insulation. More particularly, the present invention relates to storage and transportation containers that comprise a bag-like or box-like container that can be hand-held and that can provide good thermal insulation.

Discussion of the State of the Art

There is an increasing trend for food and meals shopping to be ordered by online shoppers via websites on the internet; Ocado is a British online supermarket that describes itself as 'the world's largest dedicated online grocery retailer'. In contrast to its main competitors, the company has no chain of stores and does all home deliveries from its warehouses. Gousto is a British meal kit retailer, headquartered in London, which supplies subscribers with recipe kit boxes which include ready-measured, fresh ingredients and easily followed recipes. Such meal delivery services provide organic, local produce in exact portion sizes for specific recipes, which are claimed to reduce waste and seeks to encourage healthier, delicious, and convenient home-cooked dining. Amazon is the largest online retailer and also provides grocery offerings through "AmazonFresh". Instacart is an American technology company founded in 2012, which operates as a same-day grocery delivery and pick-up service in the U.S. and Canada. Customers shop for groceries through the internet or via a mobile app from the company's more than three hundred national, regional, and local retailer partners.

It is believed that because of the claimed reduced time for leisure, modern-day professionals do not have time to go shopping at the end of the day and instead search for groceries to buy online. Options such as free shipping and reduced costs for repeat items are promoted to gain and retain subscribers. This also negates a perceived need for a vehicle to go shopping and return with purchases. Accordingly, the online purchase sector is creating a new market which will be refined as the sector becomes further developed. Equally with the mandatory so-called "lock-downs" at national and local levels, arising from the Covid-19 pandemic, there has been an exponential rise in the provision of such deliveries.

One of the most challenging sectors of the retail market today is the grocery segment, specifically e-grocers. Major players in the e-grocery landscape differentiate themselves by the types of products and services they offer, particularly, by their method of order fulfilment and delivery and by the geographical markets in which they operate. A significant limiting factor in the e-grocery business, however, is the fact that generally, many ordinary grocery items are perishable, namely those goods that are not pantry items and need to be stored in a refrigerator or a freezer. This category includes products like fresh vegetables, dairy produce, and meats. Given that a goal of these companies is to replace consumers' trips to the grocery store completely, there must be an economical provision of containers that have, ordinarily, a single use life expectancy that can extend the e-grocer's requirement to enable product selection to extend from non-perishables to perishables, given that transport and delivery must extend to protection from delivery temperature variation and to include being left outside in the mid-day sun prior to being picked up in the evening when members of a household return to pick-up the delivery box at the start of the drive or positioned just off the sidewalk, in front of the house. Additionally, given that city dwellers are less likely to have a personal vehicle, such customers often need to use public transportation for shopping. Having groceries delivered to their door rather than carrying them in crowded buses or subways is a big advantage. There is, however, an increasing use of a plethora of plastic bags to contain separate goods and to maintain them in as fresh a state as possible, to protect the goods from physical damage arising from settling, direct contact with other produce and from transport trauma together with the benefit of preventing contamination with other goods in the event of spoilage.

In the field of movement and supply of produce and materials, there is a widespread requirement to protect a thermally sensitive load to ensure that certain types of produce and materials do not pass-through certain temperature thresholds. It is well known that, for example, vegetables when subject to extremes of temperature that they become flaccid, as the cell structure is broken down through the formation of icicles when allowed to become too cold or through dehydration when allowed to become too hot, with a likely resultant formation of mold. Equally, flavors of foodstuff can diminish, whilst the efficacy of vitamins such as thiamine, niacin, folate and vitamin C can be reduced when allowed to become too hot or frozen. All foods must be delivered to consumers in a way that ensures that they do not become unsafe or unfit to eat. Foods that need refrigerating must be kept cool while they are being transported. This may need to be packed in an insulated box with a coolant gel or in a cool bag. The food industry and related industries are typically provided with guidance at a national level, to provide guidance on how to comply with food hygiene legislation. 'Perishable foods' are defined in this context as those that are required by law, for food safety reasons, to be kept chilled/refrigerated and can be marked with a 'use by' date.

Typical means for shipping temperature sensitive materials involves the use of an insulated box, with the necessary shipping and warning labels, along with some cooling agent. These cooling agents have typically been, for example, a frozen gel, dry ice, or water-based ice, placed within an insulator packing agent, such as cotton or, latterly, plastics materials such as expanded polystyrene foam, wherein heat is absorbed by such cooling agents. Low-cost temperature control in the transport industry can rely upon a number of layers of plastics foam to retain an inside temperature subject to the thermal path to a transported product from an outside the outside to maintain ideal operating temperature, as disclosed in WO02085749 in the name of the present applicant. WO02085749 teaches of a transport container which comprises of a substantially rigid liner, with flexible plastics foam surrounding the liner, and two substantially rigid plugs insertable at either end inside the liner to retain the liner in a non-collapsed configuration whereby to hold transportable contents therein. Polyethylene foam is not rigid and necessitates an encasement or be otherwise supported by way of a secondary rigid element. Furthermore, a significant issue in today's emphasis on the use of products that can be readily be recycled is that polyethylene, without special treatment, is not readily biodegradable, and thus accumulates in landfill etc.

Numerous insulated containers have been developed over the years, with those deploying a phase change material (PCM) generally providing superior temperature control over extended periods. Whilst these phase change systems can work well, they are relatively expensive to purchase and to operate. Furthermore, the phase change material suffers from not being particularly degradable, which is issue is reflected in the use of conventional prior containers where polystyrene and polyethylene foams, as used for insulation, do not degrade readily, leading to similar disposal problems. An alternative phase change coolant is dry ice, but this is classified as being potentially dangerous in view of the fact that carbon dioxide gas evolved during shipment can be dangerous to shipping personnel, necessitating the use of hazard warnings and, sometimes, the payment of additional fees. Additionally, outright bans on dry ice are pending in several areas. Notwithstanding this Amazon and Instacart employ dry ice coolant systems. Finally, wet ice poses handling problems in packing, as well as leakage and product soaking problems.

Whilst cardboard totes and brown paper bags are curbside-recyclable, plastic produce bags are not necessarily so, moreover, customers of a number of internet delivery firms are specifically requested to use designated store drop-off locations for certain types of plastics, meaning that such plastics are recyclable in name only. Furthermore, the insulated bag liners should be reused but might not necessarily so and being mixed plastics are less easily recycled as such. Regarding coolant packs, if merely frozen water bottles, then the water is consumable and the plastic bottles recyclable. However other types of coolant are less recyclable as such. GB438189 to Beech's Chocolates Ltd discloses a cardboard box for storing and transporting confectionery and provides one or more compartments for an evaporating solid refrigerant such as solid carbon dioxide with walls contiguous with walls of the box, and is provided with movable interlocking partitions providing cells for the confectionaries, the walls of the refrigerant compartment and some or all of the interlocking partitions having openings at the bottom to provide a path to all the cells for the refrigerant vapor.

What is needed is a thermally stable container that can provide a simple passive arrangement for use with and without phase change materials for the storage and transportation of goods, especially those goods ordered with respect to e-grocers and the like that can enable groups of products with different temperature profiles to be reliably maintained within a particular temperature range.

SUMMARY

Accordingly, the inventor has conceived and reduced to practice, a bag or bag-like transport container or delivery container that can provide a high degree of thermal insulation. More particularly, the disclosed invention relates to an improved container for storage and transportation of goods that comprises a bag-like or box-like container that can be hand-held and that can provide good thermal insulation. The disclosed invention seeks to provide an improved corrugated sheet container and provides a system having first and second cellulose fiber bag-like elements, at least one of which is provided with a surface metallization treatment whereby to provide beneficial thermal characteristics.

According to a preferred embodiment, an improved container for the storage and transportation of goods is disclosed, the container comprising: an outer container, comprising: a cellulose fiber bag-like element having a base, an upstanding circumferential wall, wherein an upper edge of the wall defines a closable opening to volume-adjustable storage compartment defined by the inside faces of the circumferential wall and base, and; an inner container, comprising: a cellulose fiber bag-like element having a base, an upstanding circumferential wall, wherein the inner container is formed from at least single-sided corrugate sheet material, characterized in that at least one surface of the corrugate sheet material has a metallic thin-film coating.

According to various aspects of the invention, the single-sided corrugate sheet material is formed from a fluted sheet material and a planar sheet material, each having an inner face and an outer face, wherein at least one inner face is provided with a thin film metallic coating; the metallic thin-film coating is formed from aluminum; the metallic thin-film coating is applied such that the recyclability of the cellulose fiber product is not diminished by the amount of metal present; the metallic thin-film coating is applied by vacuum deposition techniques, the corrugated material of the single-sided corrugate sheet material, is apertured; the apertures of the corrugated material are formed in at least one shape selected from the group of square, rectangular, round, oval, triangular, polygonal, and combinations thereof; the wherein corrugated material is cut into lengths and arranged in a spaced side-by-side relationship; the outer container includes an adhesive tab operable to attach an upper edge element of a first side of the container to an opposite facing, second side of the container, whereby to close the outer container; the outer container includes a fastener element upon an upper edge element of a first side operable to attach to a corresponding fastener element on an opposite facing, second side of the container, whereby to close the outer container; the inner container includes an adhesive tab operable to attach an upper edge element of a first side of the inner container to an opposite facing, second side of the inner container, whereby to close the inner container; the inner container includes a fastener element upon an upper edge element of a first side operable to attach to a corresponding fastener element on an opposite facing, second side of the container, whereby to close the inner container; at least one of the inner and outer containers is formed from kraft paper sheet; at least one of the inner and outer containers is formed from cellulose paper sheet; at least one of the inner and outer containers is a composite sheet material formed from paper and plastics fiber; the corrugated sheet is cellulose-based and wherein the layers of sheet and fluted corrugations are glued or otherwise connected to each other; the container further comprising one or more temperature control packs for placement within the inner container; the temperature control packs include phase change materials contained in sealed containers the container further comprising one or more temperature control packs for placement within the outer container and outside the inner container; and the temperature control packs include phase change materials contained in sealed containers.

BRIEF DESCRIPTION OF THE DRAWING FIGURES

The accompanying drawings illustrate several aspects and, together with the description, serve to explain the principles of the invention according to the aspects. It will be appreciated by one skilled in the art that the particular arrangements illustrated in the drawings are merely exemplary, and are not to be considered as limiting of the scope of the invention or the claims herein in any way.

Figure 6A:
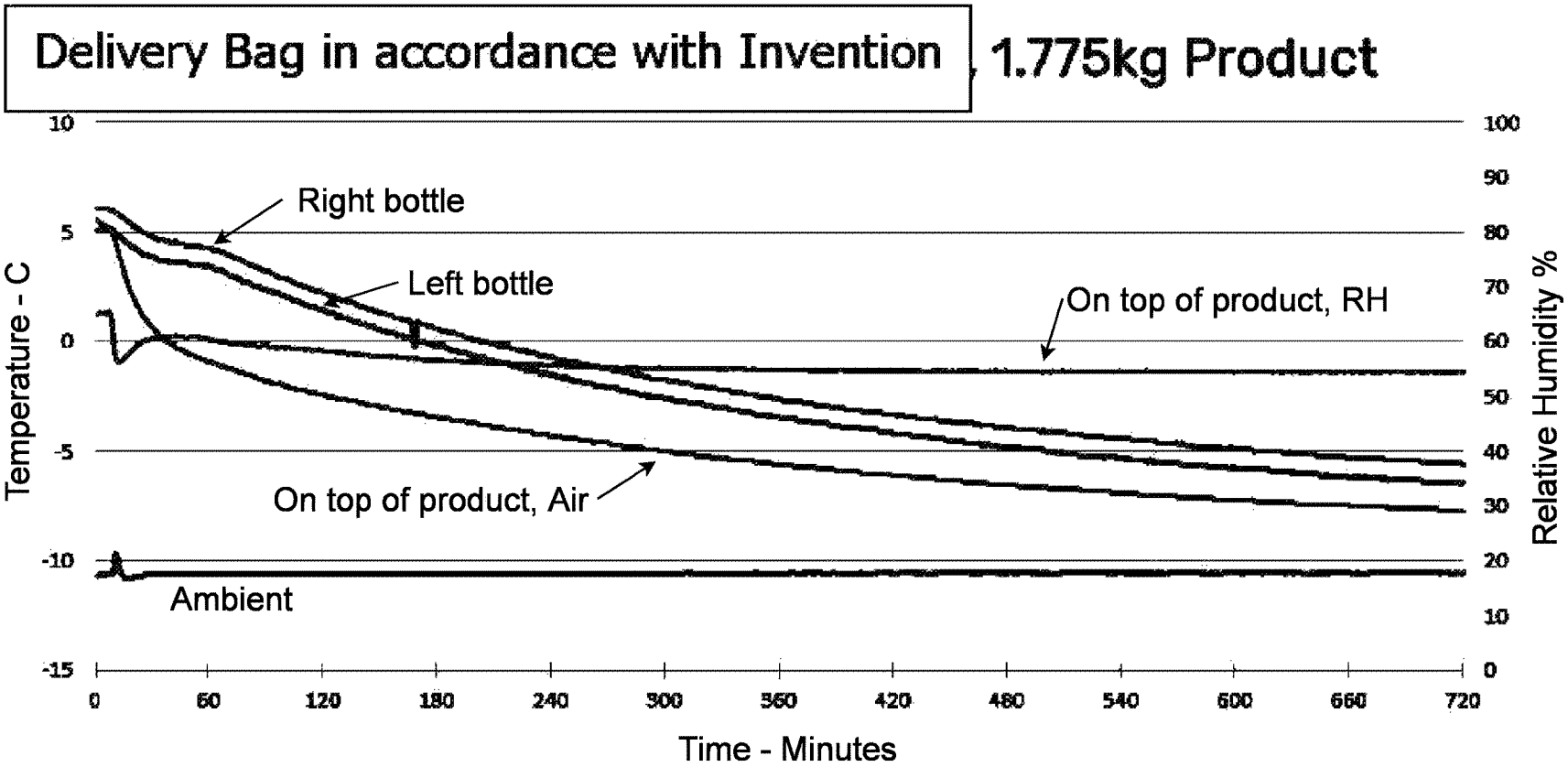
FIG. 6A shows a temperature over time graph in respect of a first experiment.

FIG. 6B tabulates specific temperature data in relation to the graph of FIG. 6A and over time graph in respect of the samples of the first experiment.

Figure 7A:
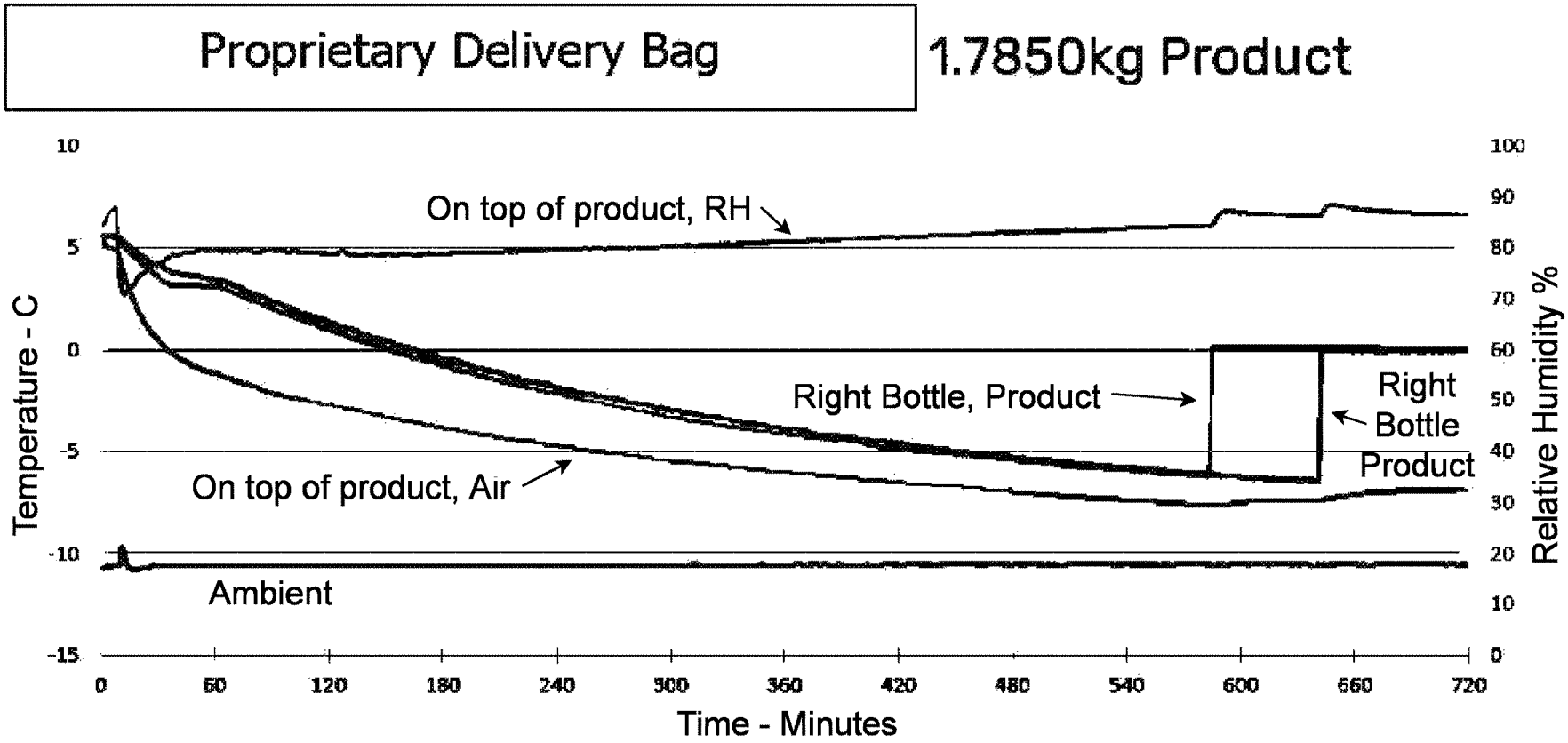

FIG. 7A shows a temperature over time graph in respect of a second experiment.

FIG. 7B tabulates specific temperature data in relation to the graph of FIG. 7A and over time graph in respect of the samples of the second experiment.

Figure 8:
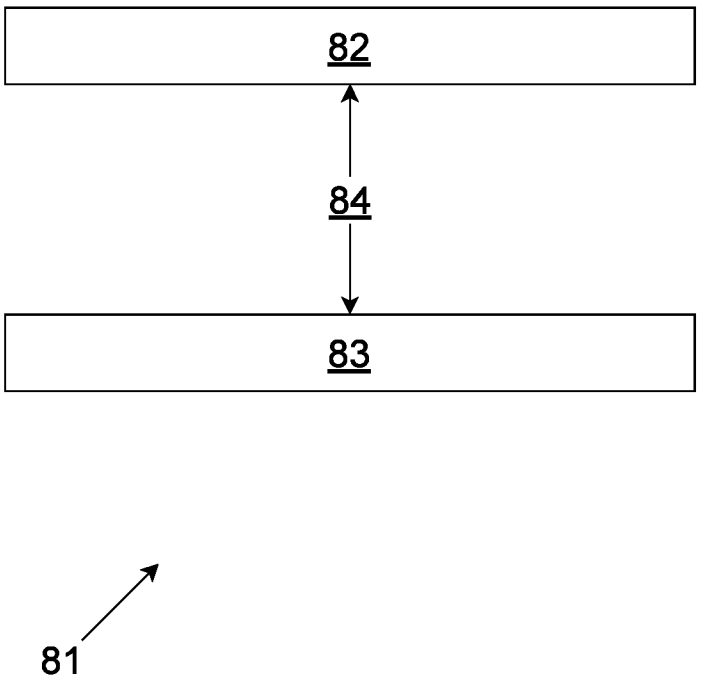

FIG. 8 illustrates a conceptual aspect of the invention.

FIG. 8A illustrates variations in conductivity at different temperatures.

Figure 8B:
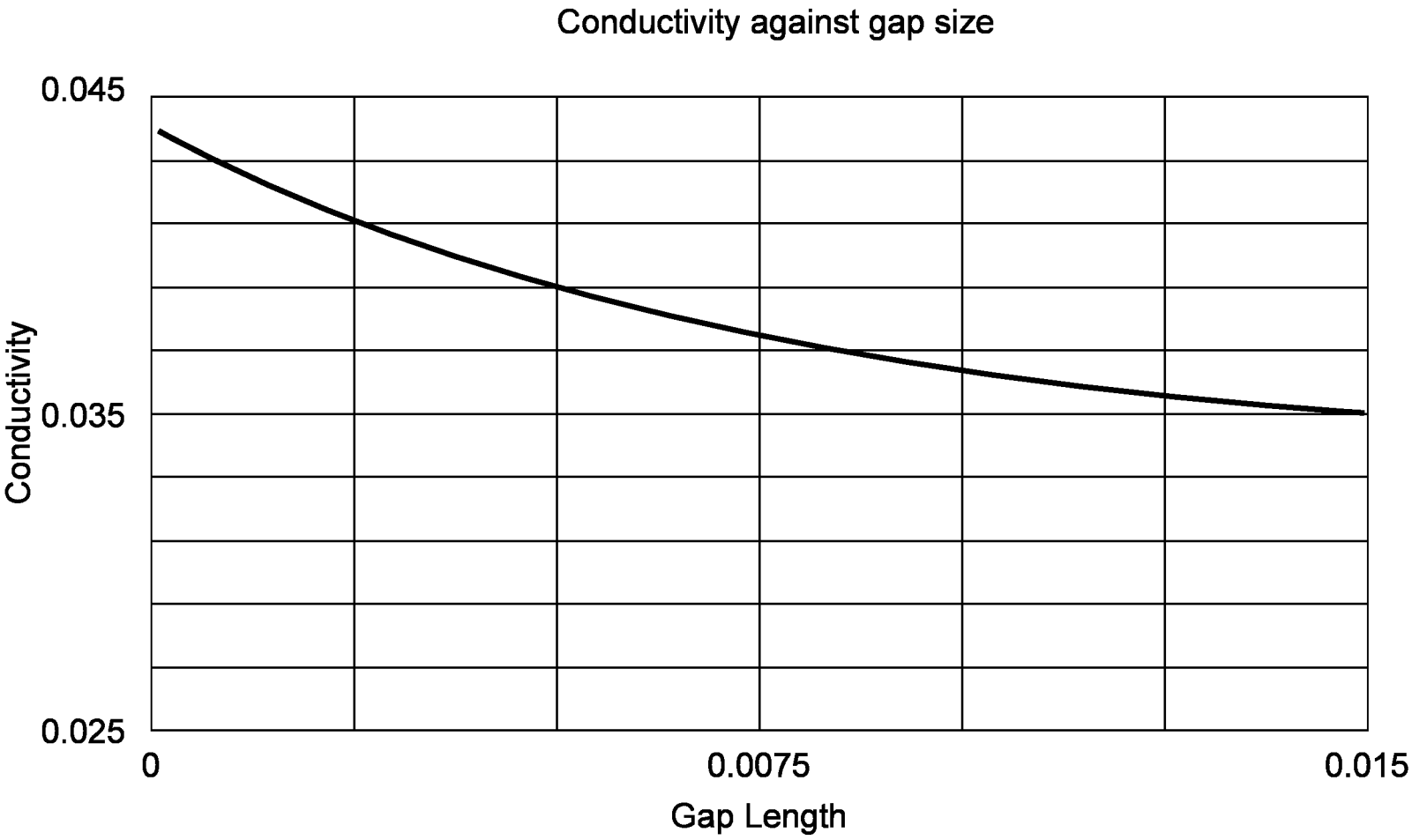

FIG. 8B shows a graph depicting conductivity versus gap size of an example in accordance with the invention.

Figure 8C:
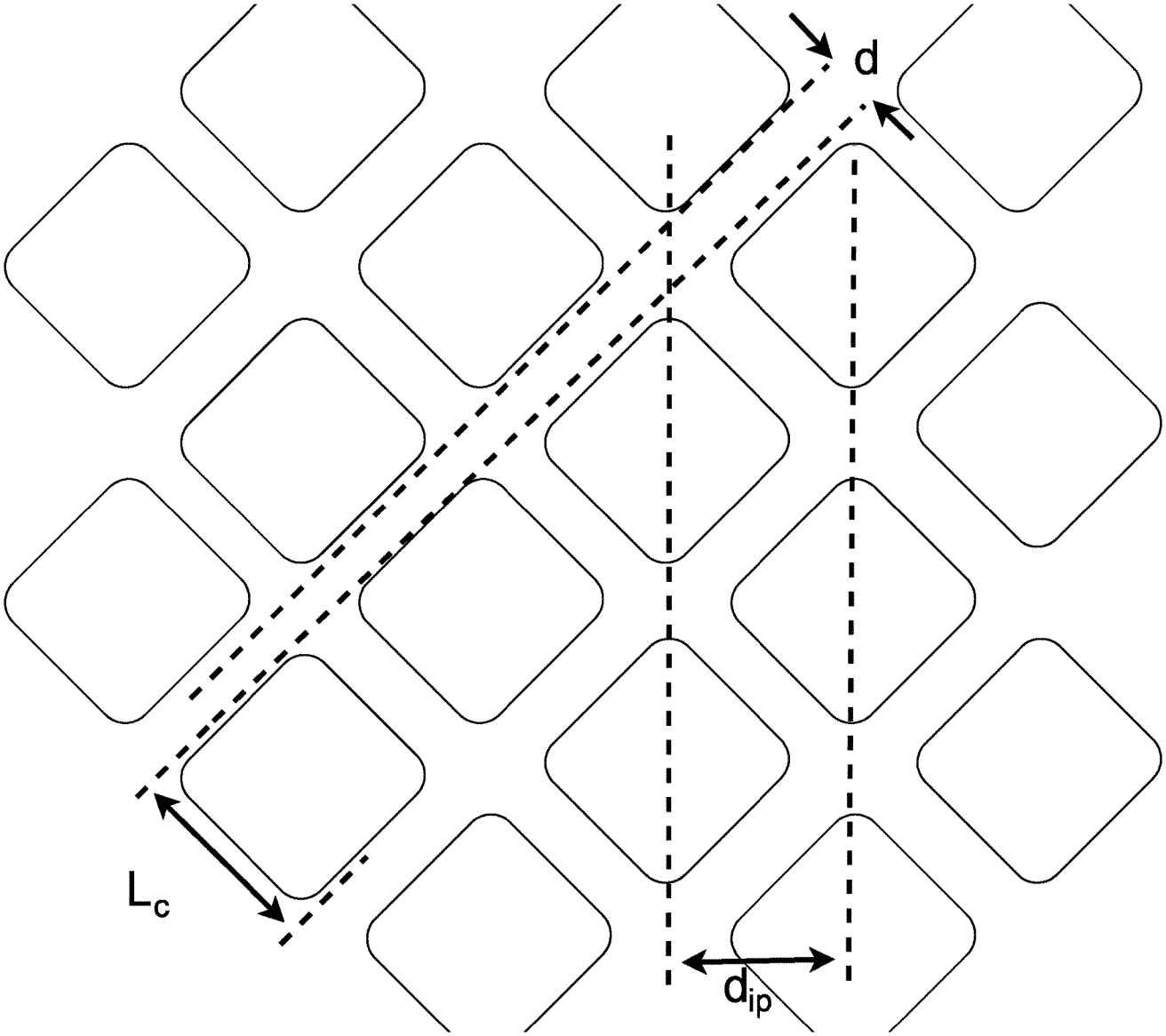

FIG. 8C shows a first design of insulating sheet spacer having square apertures, with rounded corners, with the squares being arranged diagonally with respect to an axis of corrugation.

Figure 8D:
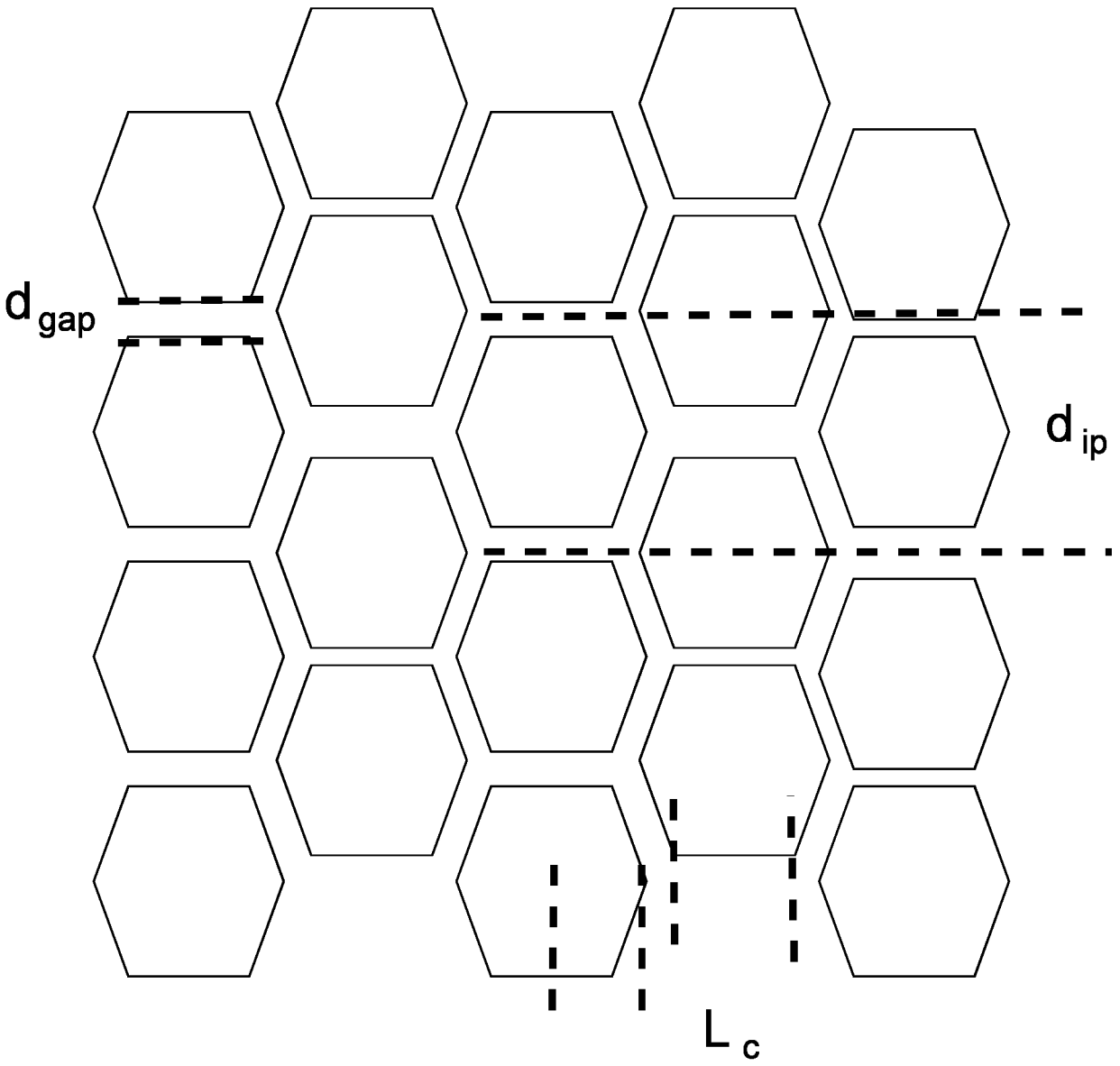

FIG. 8D shows a second design of insulating sheet spacer having hexagonal apertures.

Figure 8E:
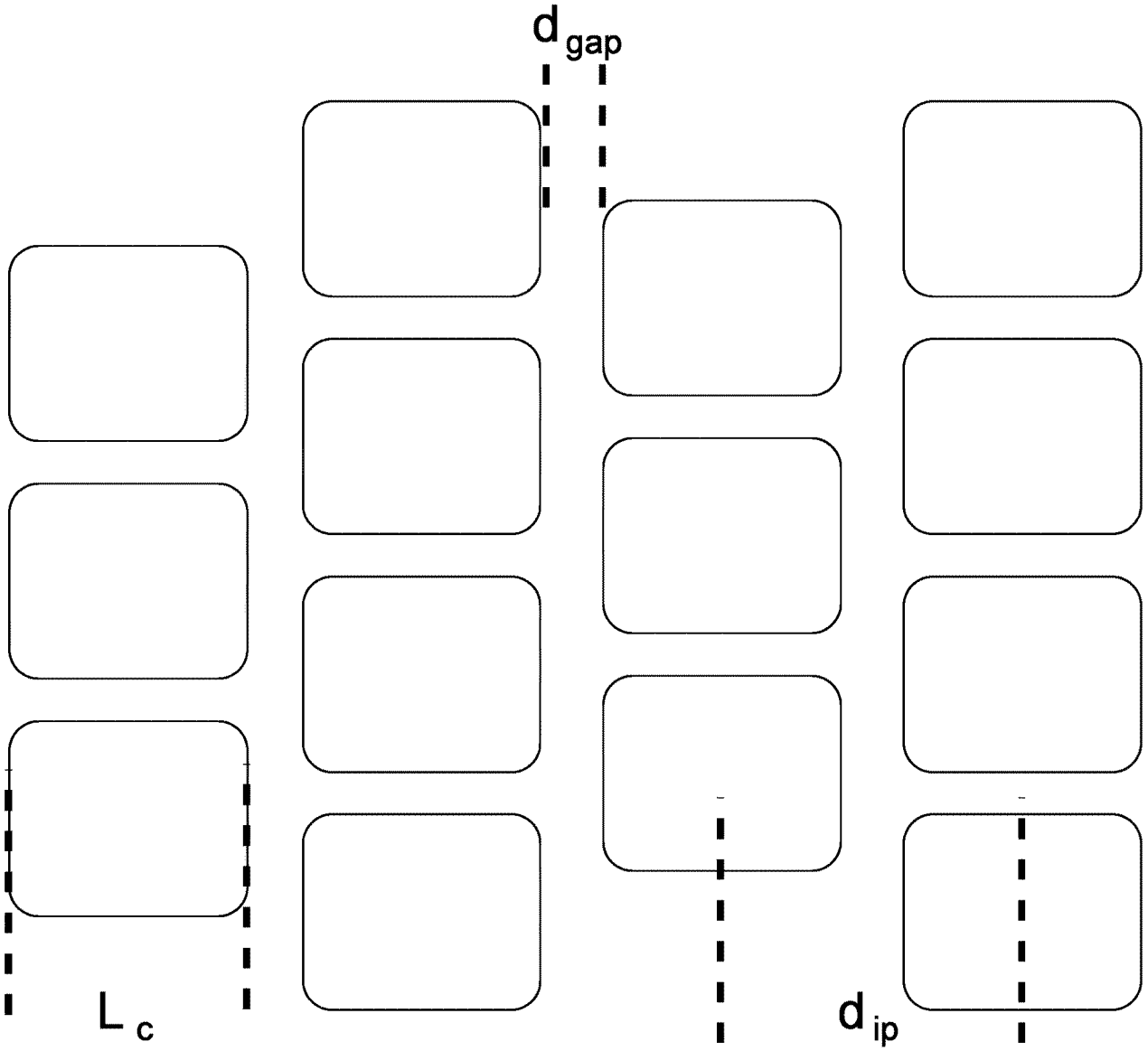

FIG. 8E shows a third design of insulating sheet spacer having square apertures.

Figure 8F:
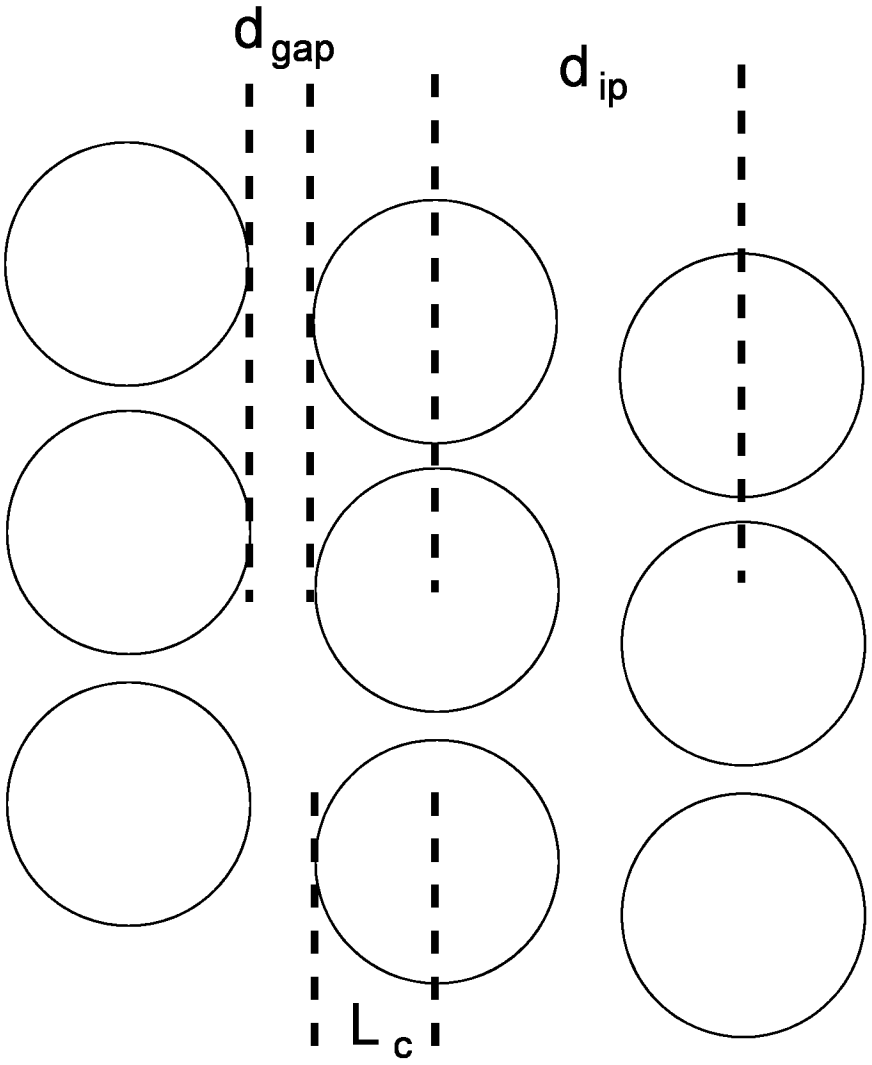

FIG. 8F show a further design of insulating sheet spacer having round apertures as used in fourth and fifth embodiments of the invention.

Figure 8G:
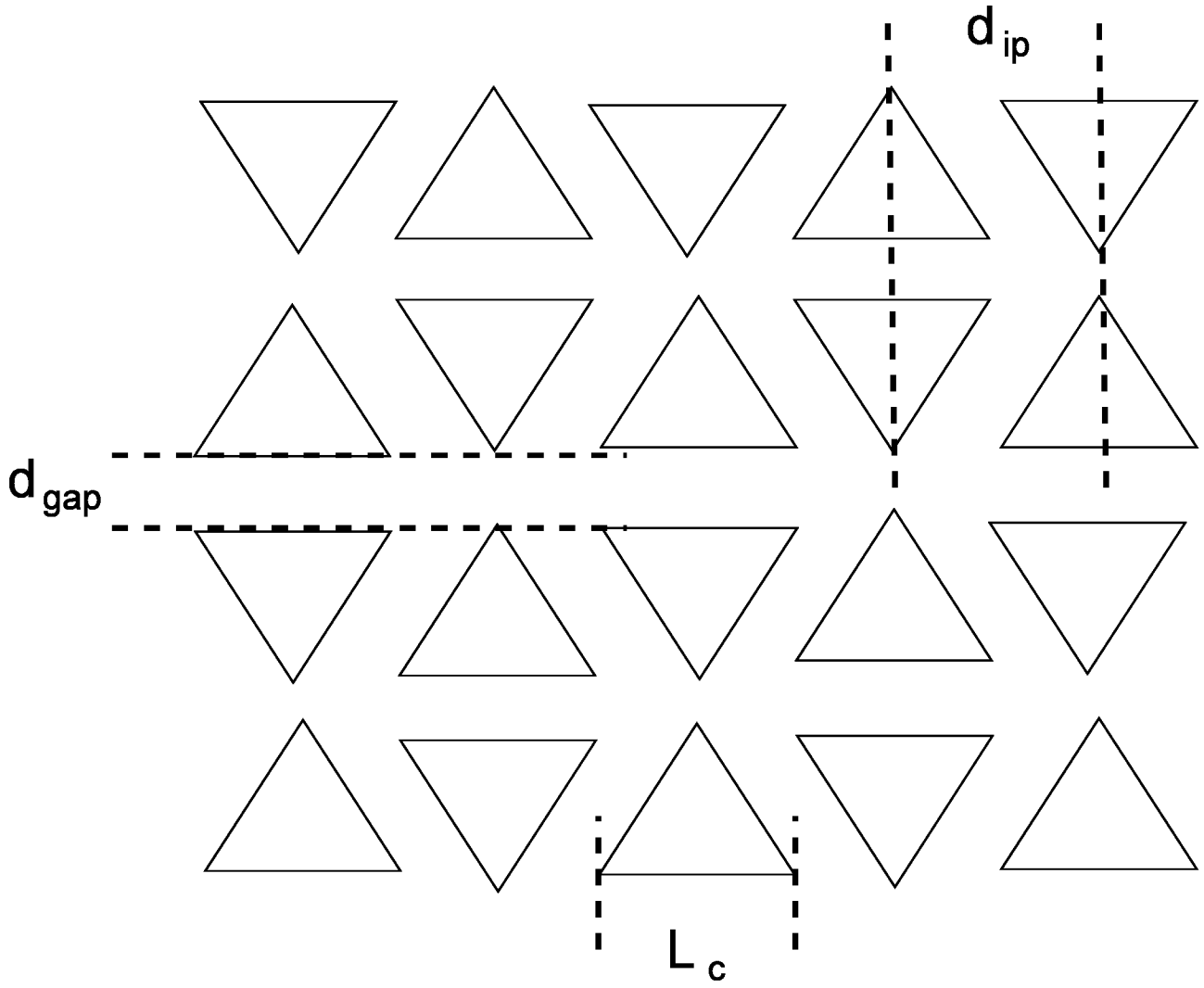

FIG. 8G shows a further embodiment wherein the apertures are triangular.

Figure 8H:
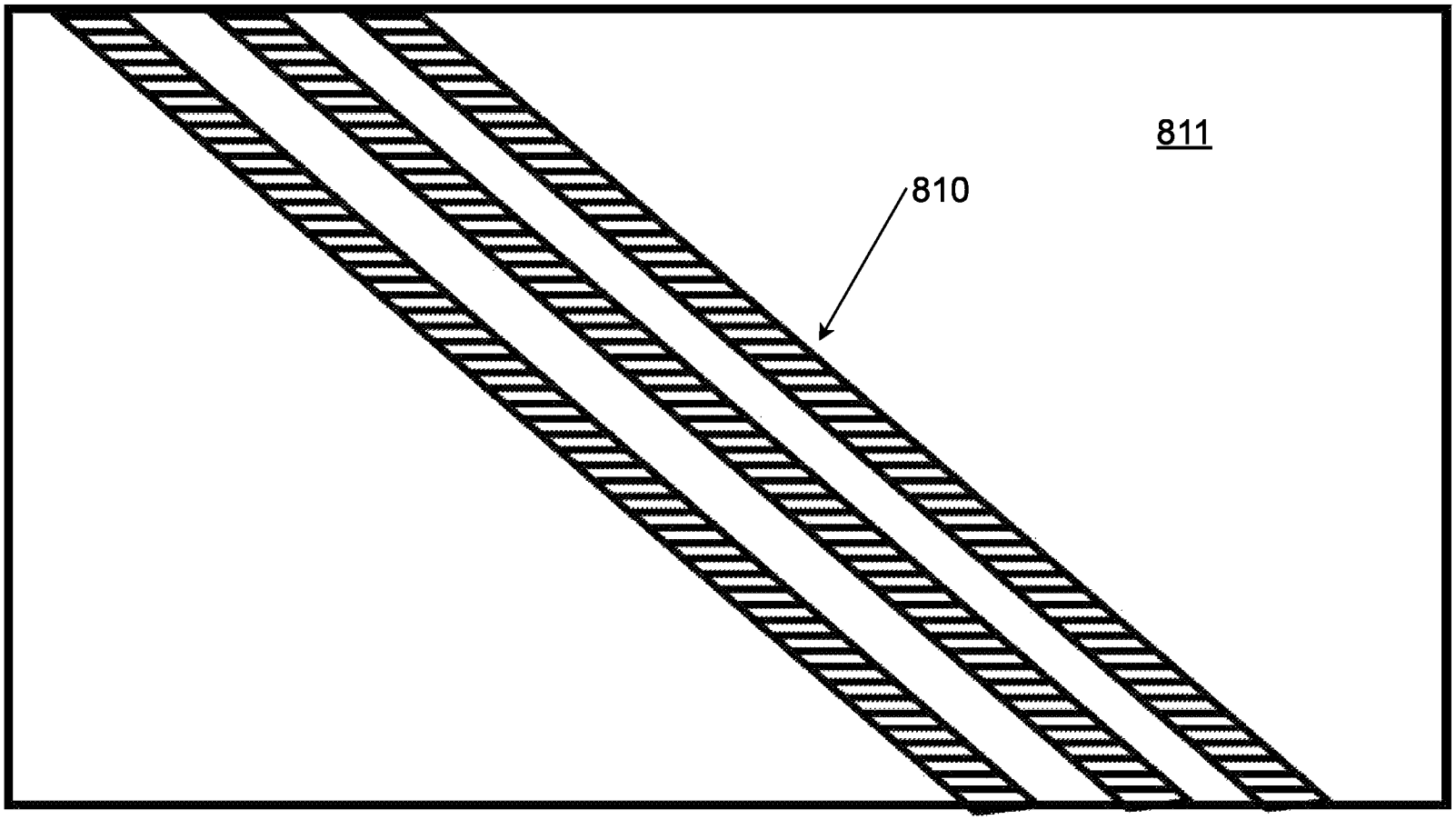

FIG. 8H shows a further embodiment wherein the corrugate material is arranged in strips.

Figure 8I:
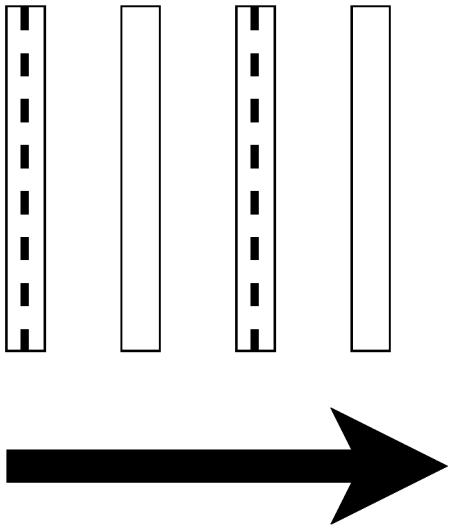

FIG. 8I shows flute direction according to one embodiment.

FIG. 9 provide data relating to density relating to various types of corrugated material which can be used to form inside surface walls of the inner container.

FIG. 10 provide data relating to thermal conductivity relating to various types of corrugated material which can be used to form inside surface walls of the inner container.

FIG. 11 provide data relating to specific heat capacity relating to various types of corrugated material which can be used to form inside surface walls of the inner container.

DETAILED DESCRIPTION

The inventor has conceived, and reduced to practice, a bag or bag-like transport container or delivery container that can provide a high degree of thermal insulation. More particularly, the disclosed invention relates to an improved container for storage and transportation of goods that comprises a bag-like or box-like container that can be hand-held and that can provide good thermal insulation. The disclosed invention seeks to provide an improved corrugated sheet container and provides a system having first and second cellulose fiber bag-like elements, at least one of which is provided with a surface metallization treatment whereby to provide beneficial thermal characteristics.

In accordance with a general aspect of the invention, there is provided a thermally insulating transport/storage container for transporting/storing temperature sensitive materials.

Thus, in a first aspect, the present invention provides an insulating container for the storage and transportation of goods, the container comprising: an outer container and an inner container; wherein the outer container comprises a cellulose fiber bag-like element having a base, an upstanding circumferential wall, wherein an upper edge of the wall defines a closable opening to a volume-adjustable storage compartment defined by the inside faces of the circumferential wall and base; wherein the inner container comprises a cellulose fiber bag-like element having a base, an upstanding circumferential wall, wherein the inner container is formed from at least single-sided corrugate sheet material, characterized in that at least one surface of the corrugate sheet material has a metallic thin-film coating.

Conveniently, the single-sided corrugate sheet material is formed from a fluted sheet material and a planar sheet material, each having an inner face and an outer face, wherein at least one inner face is provided with a thin film metallic coating. Applicants have determined that by the use of a thin film coating, the percentage weight of film has been shown not to prejudice recycling of the product at end of life of container. The single-sided corrugate sheet material may be provided in multiple layers to increase the thermal insulation; first and second multiple layers (or more) may be secured by adhesive or otherwise.

Preferably, the metallic thin-film coating is formed from aluminum, aluminum thin film coatings can be conveniently formed by way of a vacuum vapor deposition process. The thin film can be applied to one or both of adjacent corrugated material or backing support sheet material. Other forms of metal deposition are known, such as pyrolytic and photolytic depositions processes.

Conveniently the outer container includes an adhesive tab operable to attach an upper edge element of a first side of the container to an opposite facing, second side of the container, whereby to close the outer container. In the alternative, the outer container includes a fastener element upon an upper edge element of a first side operable to attach to a corresponding fastener element on an opposite facing, second side of the container, whereby to close the outer container.

Conveniently, the inner container includes an adhesive tab operable to attach an upper edge element of a first side of the inner container to an opposite facing, second side of the inner container, whereby to close the inner container. In the alternative, the inner container includes a fastener element upon an upper edge element of a first side operable to attach to a corresponding fastener element on an opposite facing, second side of the container, whereby to close the inner container.

It has been found conveniently to manufacture the inner and outer containers from kraft paper sheet, but other forms of cellulose paper sheet can be employed, even employing plastics fibers in a composite sheet material form. The corrugated sheet can be formed form kraft sheet and/or cellulose-based fiber sheet. The layers of sheet and fluted corrugations can be glued or otherwise connected to each other.

The corrugated sheet can be formed of cellulose wherein layers of sheet and fluted corrugations are glued or otherwise connected to each other. Equally, the corrugated sheet can be formed of a thermo-plastics material, such as polypropylene, which is manufactured in an extruded form. A benefit of the corrugated sheet being single sided corrugated sheet is that conformity with edge features and/or curves of a general shape defined by the container are simply realized. This is of particular benefit in the case of extruded plastics such as polyethylene, which is more difficult to bend in a direction orthogonal to the direction of the corrugated flutes.

The present embodiment may be arranged such that the flutes of the inner container are directed inwardly. A plain liner sheet may additionally be provided to ensure complete sealing with the closure members, although cellulose based products such as crepe paper may additionally be provided as packing, to eliminate passage of air as between the interior of the first container and the interior of the inner container.

The present embodiment can provide a simple to manufacture, low-cost delivery bag for e-grocery businesses. Indeed, in a further embodiment, the multi-layered corrugated sheet wall member could be provided with two or more sections along its axial length where the number of layers of corrugated sheets in these two or more sections differ, whereby the R-value would vary along the axial length (the R-value of a sheet material is a measure of how well the material, resists the conductive flow of heat). This could provide an advantage in that, with regard to home delivery of grocery items, temperature sensitive products such as ices could be placed within a sub-zero compartment; whilst temperature sensitive salad produce is separated in a different temperature zone. Data tracking systems could be employed to provide advice of delivery and with regard to security; temperature sensors could be provided to indicate an inside temperature of the contents, to dissuade early opening of a grocery box.

The manufacture of the present embodiment can be as simple as cutting a portion of corrugated sheet material using a die-board cutter as is ubiquitous in the industry. As is known, single sided corrugate board can, in addition to being provided in a sheet form as is the case of dual faced and multiple corrugate board but can also be provided upon a roll. The corrugated board, once cut to the correct dimensions, can be secured in position by adhesive tape or glue. In accordance with a further embodiment, the corrugated board may be provided in a form such that the corrugated element is apertured. The apertures of the corrugated material are formed such that they have a generally square, rectangular, round, oval, triangular shape. In an alternative, the apertures are defined by the placement of strips of corrugated material, wherein the corrugated material is placed onto a support and arranged in a spaced side-by-side relationship. The provision of the apertures—for example by way of a stamping procedure—or by arrangement of strips not only reduces the amount of corrugated material, but also has been found to increasing an R-value of the material relative to a non-apertured sheet material.

Notwithstanding the problems encountered by known systems which employ phase change materials for short-term use, it will be realized the present invention will also benefit in terms of duration of temperature control the use of phase change material temperature control packs that include one or more phase change materials, are contained in sealed containers can be provided to further increase a period of time within which temperature stability can be achieved. The sealed containers for phase change materials can be provided by one of a plastics bag, a blister pack, a sheet cellulose package, a sealed polymer enclosure. Present Applicant Company is involved in the development of fiber-based and recyclable phase change materials. The temperature control packs can be configured to provide a defined thermally stable atmosphere within the payload volume for a number of days as is typical for international travel, for example. The phase change material could also be arranged to be installed in cut-outs defined with the walls of the container, or between layers of corrugated material.

Figure 1:
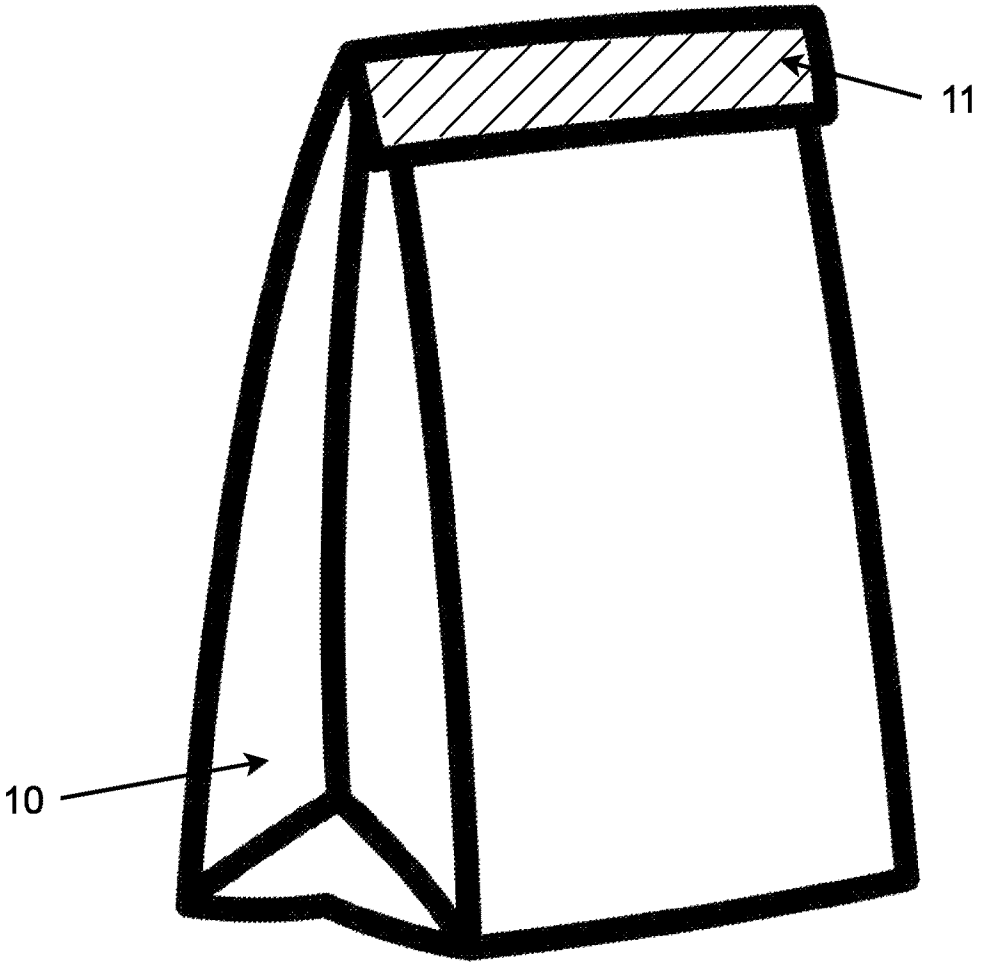
FIG. 1 shows a first example of a first embodiment of a container in accordance with the present invention.

Referring to FIG. 1, there is shown a first embodiment of the invention 10. The bag 10 is conveniently made from kraft paper, being paper or paperboard produced from chemical pulp produced in the kraft process. Kraft paper, also known as sack paper, is a porous paper with high elasticity and high tear resistance and is widely used for packaging products with high demands for strength and durability. The kraft process does not involve the use of acidic sulfites which sulfites tend to degrade cellulose more, leading to weaker fibers. Moreover, the kraft process pulping removes most of the lignin present originally in the wood increasing the strength of the resultant product, since the presence of the hydrophobic lignin, interferes with the formation of the hydrogen bonds between cellulose (and hemicellulose) in the fibers. Accordingly, pulp produced by the kraft process is stronger than that made by other pulping processes. Each bag is shown upstanding on its base with a clear sticky-back plastics adhesive tape 11 closing the bag at the top, to secure the contents once placed within an insert, as shall be discussed below. Obviously, paper tape or other alternatives could be employed. Kraft pulp is darker than other wood pulps, but it can be bleached to make very white pulp. Fully bleached kraft pulp is used to make high quality paper where strength, whiteness, and resistance to yellowing are important. Notwithstanding this, by the preferred use of metallization, the actual color of the kraft paper can be disregarded. Whilst kraft paper is available in weights of 40-135 gm-2, it has been found that the primary, outer bag in accordance with the invention having a weight of 110 gm-2 has performed satisfactorily.

Figure 2A:
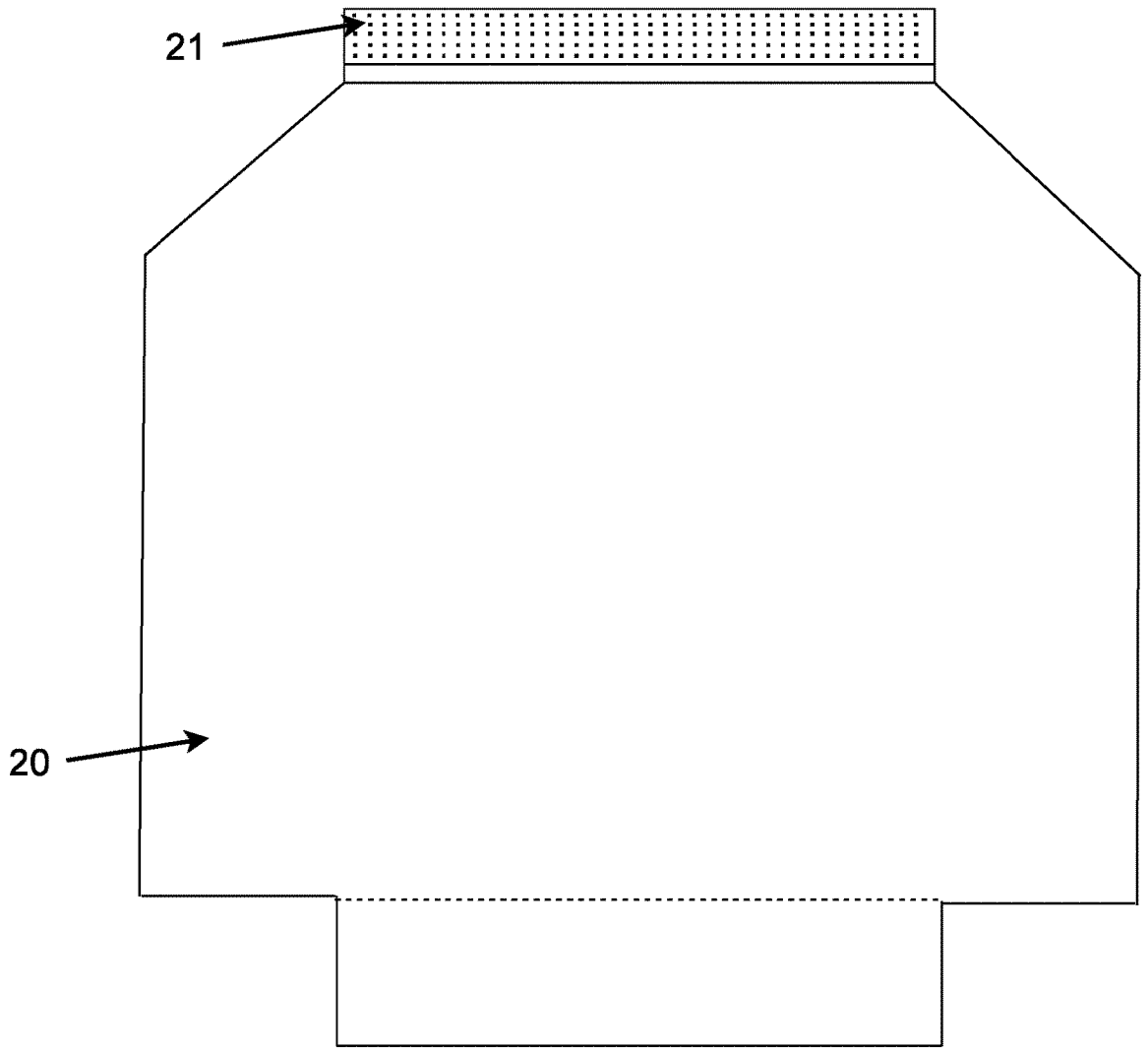
FIG. 2A illustrate an insert of the first embodiment in a folded state.
Figure 3:
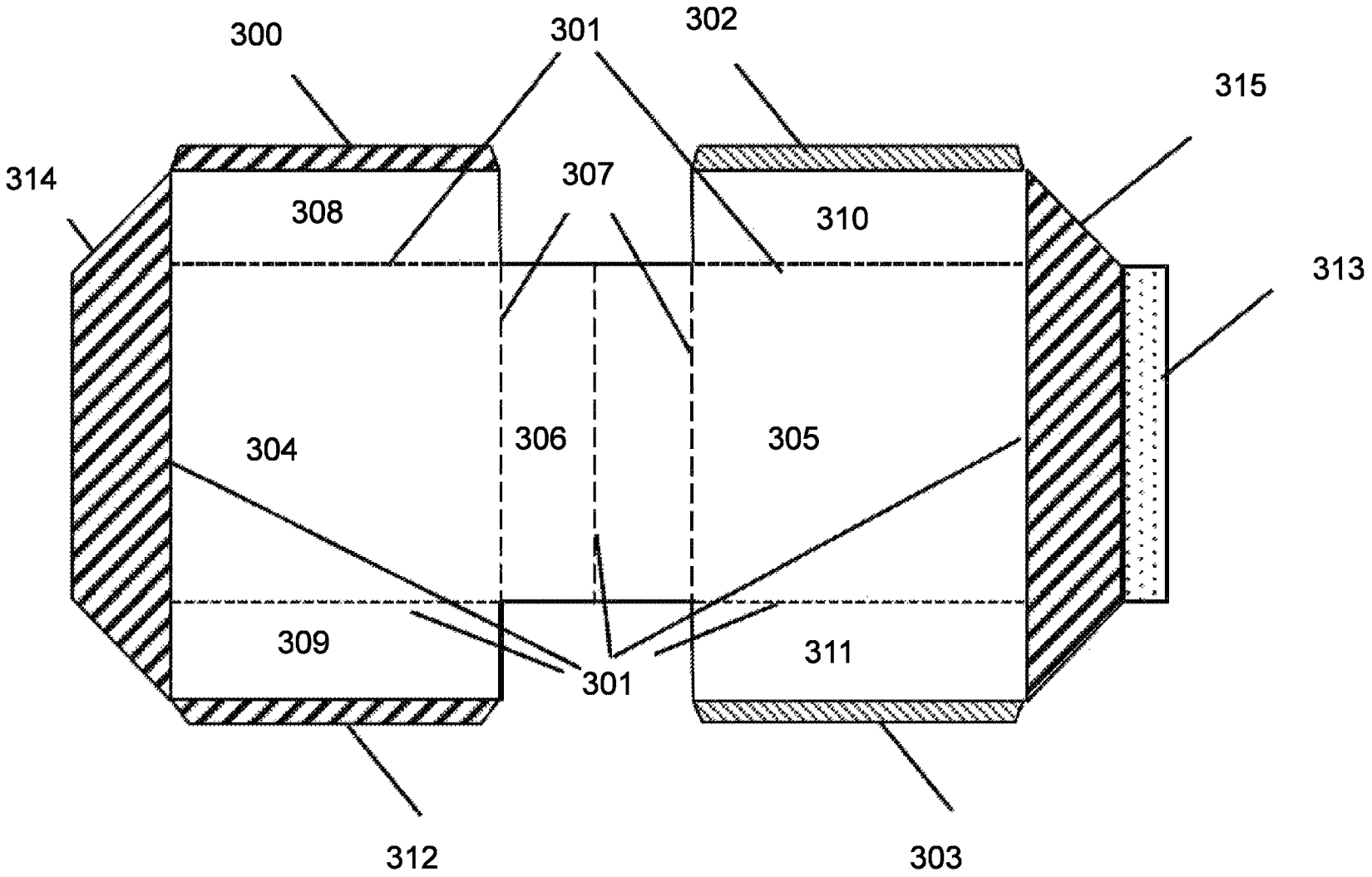
FIG. 3 illustrate a plan view of the first embodiment prior to folding.
Figure 4:
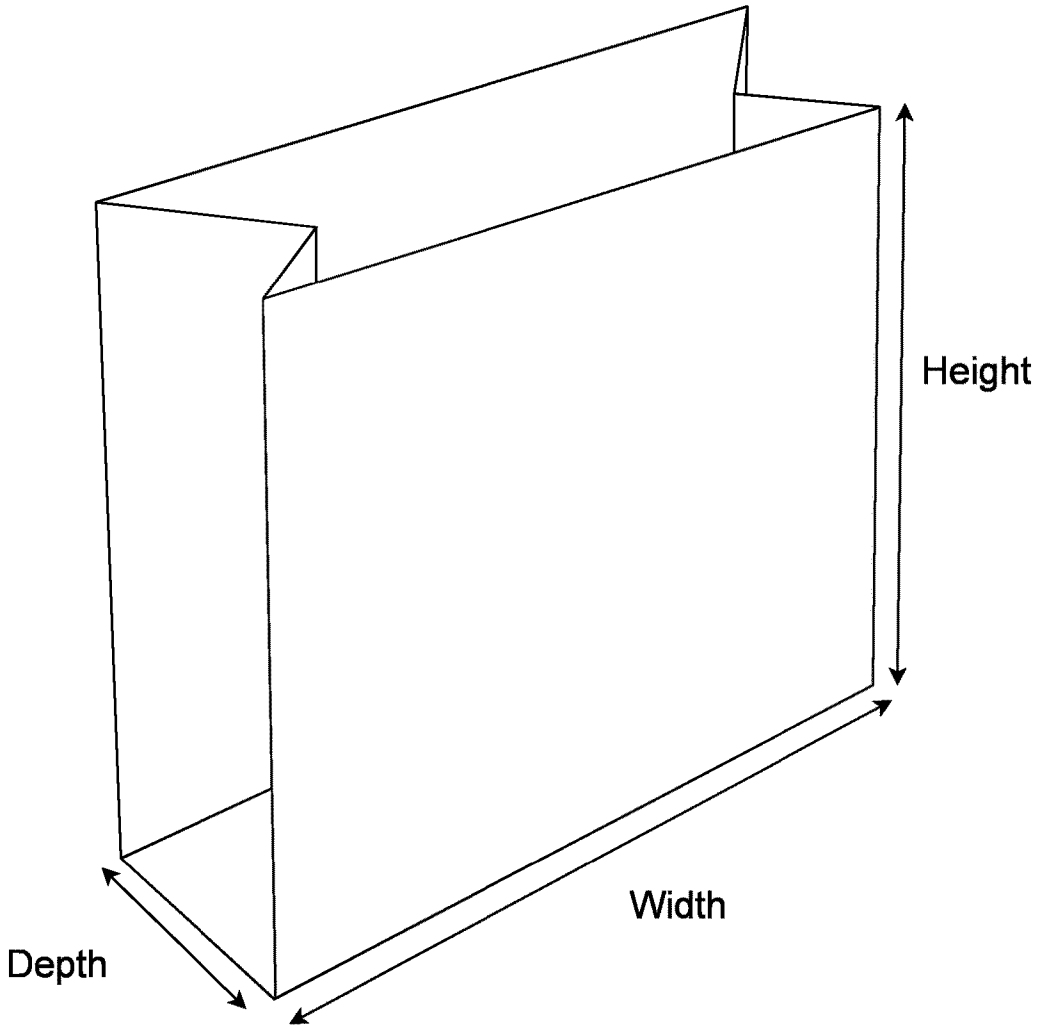
FIG. 4 shows a bag created by the plan view FIG. 3.

FIG. 2A shows an insert 20 of the first embodiment with adhesive strip 21, while FIG. 3 shows the insert in plan view prior to fabrication, the insert being formed from a single faced C-flute brown kraft self-assembling insert. The fluting being arranged to form the outer surface of the insert. The insert is provided with a metallization layer over at least one surface of the fluted and non-fluted sheets. The outline per FIG. 3 can be simply die-cut from a single faced C-flute sheet, as is known. In detail, the die-cut board is shaped to provide two main faces, 304, 305, which are each connected to the base element 306 about parallel fold lines 307; other fold lines are indicated more simply, by 301. Either side of the main faces, 304, 305, are side elements 308-311, with elements 308, 309 having adhesive tabs 300, 312, whilst elements 314, 315 have tack tabs 302, 303, which respective adjacent elements are fastened to each other. Cover flaps 314, 315 depend from the top edge of the main faces and a further adhesive tab 313, or similar attachment, is used to close cover flap 315 upon cover 314.

Figure 5:
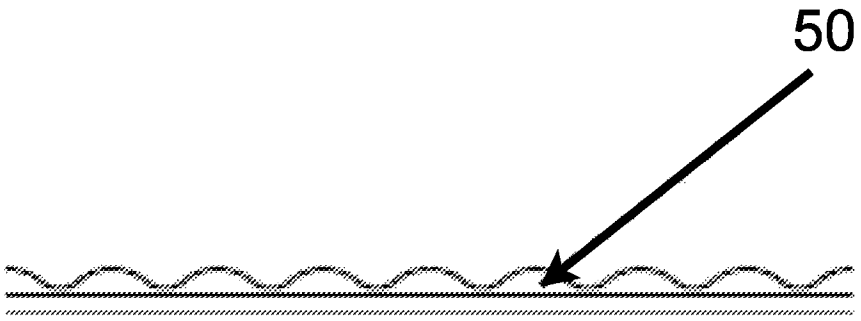
FIG. 5 shows a section of a single-sided corrugated material.

FIG. 5 shows a cross-section of C-flute sheet. The basic paper can be brown kraft paper of a weight 135 gm-2; by having one of the sides of at least one of the fluted or non-fluted sheets being coated by aluminum paper, conveniently provided as a result of vacuum vapor deposition (as discussed below), a highly heat reflective paper is provided. The thickness of the deposited aluminum can be quite low and is of the order of 5-15 μm in thickness. And FIG. 5 shows a section of a single-sided corrugated material 50.

Figure 2B:
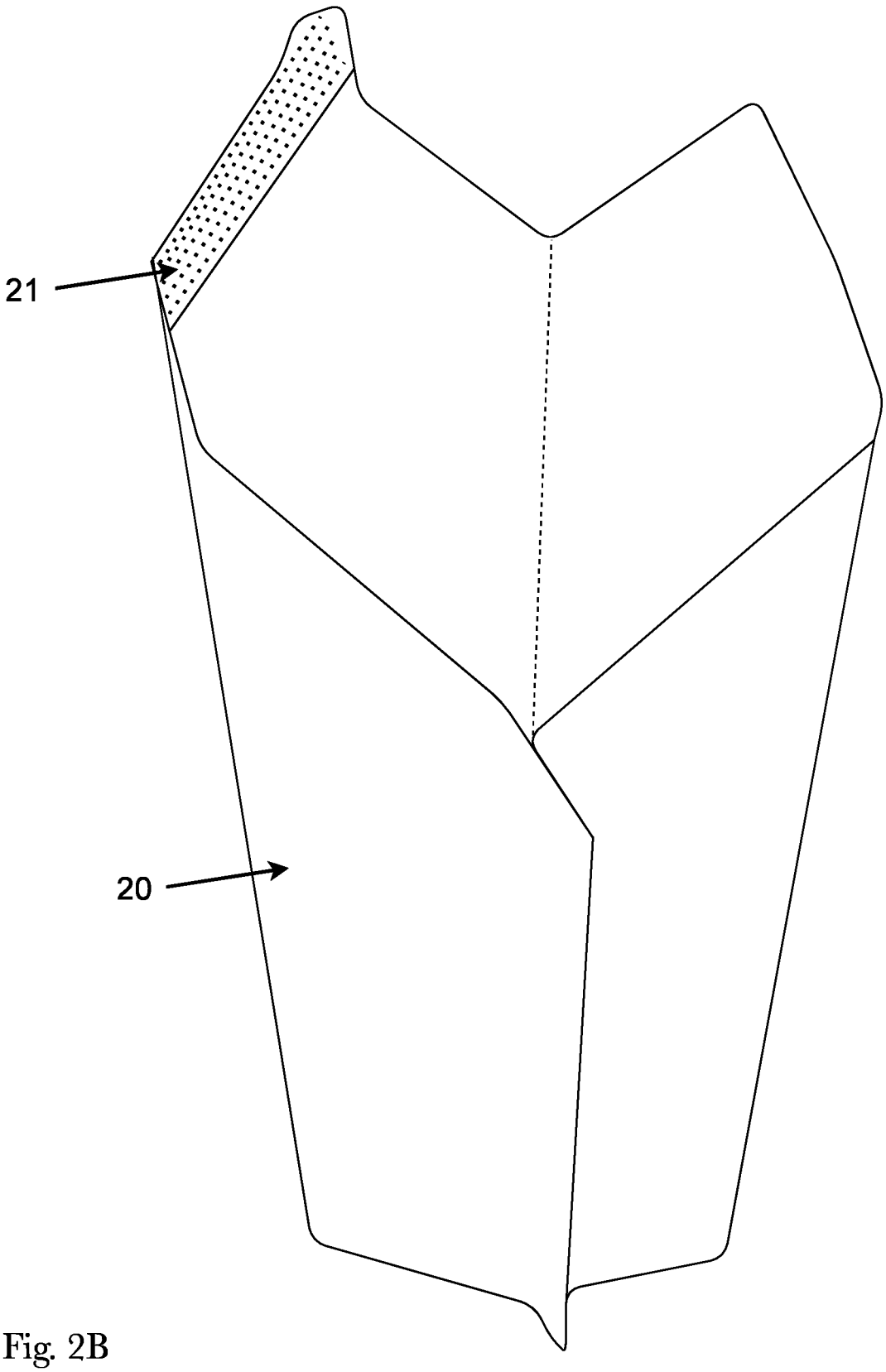
FIG. 2B shows the insert of the first embodiment standing upright prior to filling with products.
Figure 2C:
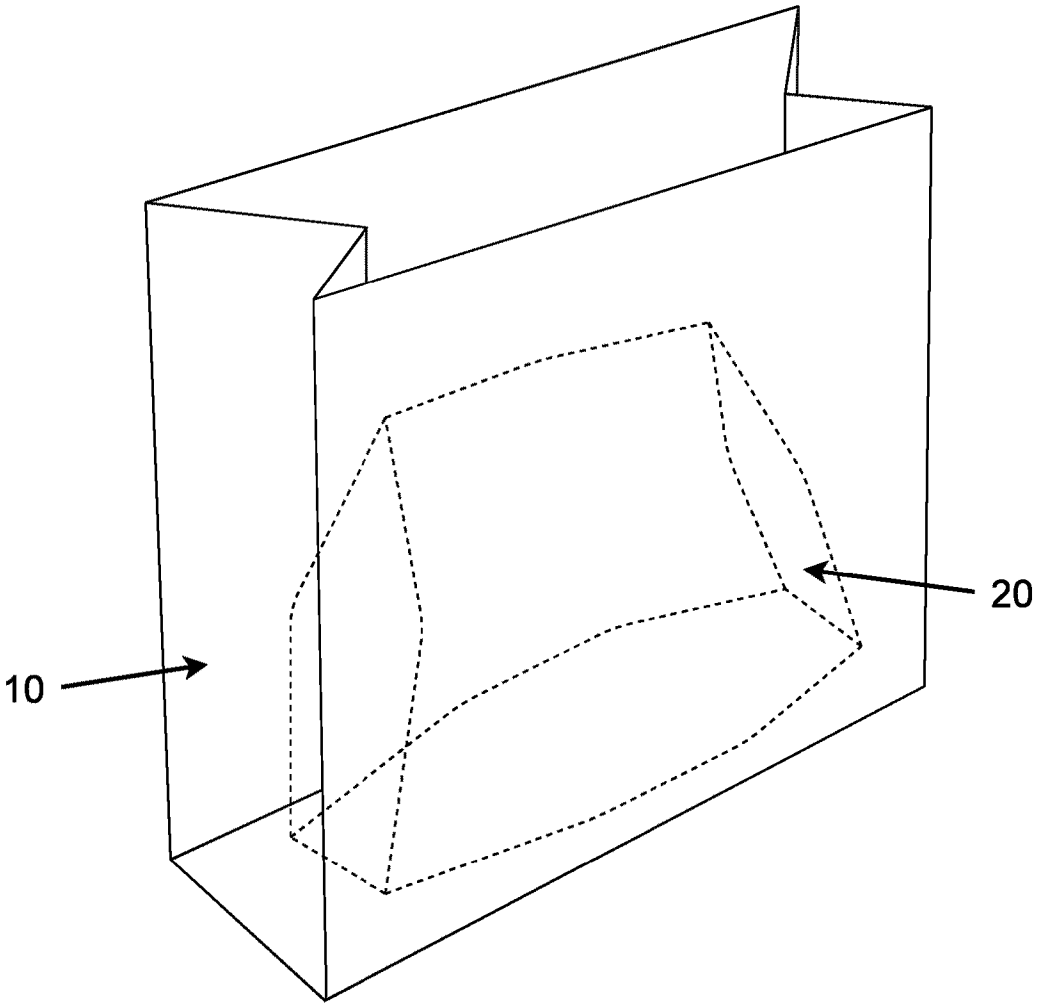
FIG. 2C shows the insert of the first embodiment in a closed state, after filling, within a container prior to closing.

Returning to the insert as such, FIG. 2B shows the insert with adhesive strip 21 once the adhesive element tabs (referring to FIG. 3: 300, 312) have been fastened to their respect tack tabs (referring to FIG. 3: 302, 303), with the base element (referring to FIG. 3: 306), flat upon the surface the insert has been placed. FIG. 2C shows an insert 20 in an external bag 10. Once the insert is filled, the cover elements of the first embodiment 20 can be folded over and secured, prior to closure of the external bag 10. In this arrangement, it can be seen that the insert 20 can now be filled with produce, conveniently once the insert has been placed in the external bag.

One or more different aspects may be described in the present application. Further, for one or more of the aspects described herein, numerous alternative arrangements may be described; it should be appreciated that these are presented for illustrative purposes only and are not limiting of the aspects contained herein or the claims presented herein in any way. One or more of the arrangements may be widely applicable to numerous aspects, as may be readily apparent from the disclosure. In general, arrangements are described in sufficient detail to enable those skilled in the art to practice one or more of the aspects, and it should be appreciated that other arrangements may be utilized and that structural, logical, software, electrical and other changes may be made without departing from the scope of the particular aspects. Particular features of one or more of the aspects described herein may be described with reference to one or more particular aspects or figures that form a part of the present disclosure, and in which are shown, by way of illustration, specific arrangements of one or more of the aspects. It should be appreciated, however, that such features are not limited to usage in the one or more particular aspects or figures with reference to which they are described. The present disclosure is neither a literal description of all arrangements of one or more of the aspects nor a listing of features of one or more of the aspects that must be present in all arrangements.

Headings of sections provided in this patent application and the title of this patent application are for convenience only, and are not to be taken as limiting the disclosure in any way.

Devices that are in communication with each other need not be in continuous communication with each other, unless expressly specified otherwise. In addition, devices that are in communication with each other may communicate directly or indirectly through one or more communication means or intermediaries, logical or physical.

A description of an aspect with several components in communication with each other does not imply that all such components are required. To the contrary, a variety of optional components may be described to illustrate a wide variety of possible aspects and in order to more fully illustrate one or more aspects. Similarly, although process steps, method steps, algorithms or the like may be described in a sequential order, such processes, methods and algorithms may generally be configured to work in alternate orders, unless specifically stated to the contrary. In other words, any sequence or order of steps that may be described in this patent application does not, in and of itself, indicate a requirement that the steps be performed in that order. The steps of described processes may be performed in any order practical. Further, some steps may be performed simultaneously despite being described or implied as occurring non-simultaneously (e.g., because one step is described after the other step). Moreover, the illustration of a process by its depiction in a drawing does not imply that the illustrated process is exclusive of other variations and modifications thereto, does not imply that the illustrated process or any of its steps are necessary to one or more of the aspects, and does not imply that the illustrated process is preferred. Also, steps are generally described once per aspect, but this does not mean they must occur once, or that they may only occur once each time a process, method, or algorithm is carried out or executed. Some steps may be omitted in some aspects or some occurrences, or some steps may be executed more than once in a given aspect or occurrence.

When a single device or article is described herein, it will be readily apparent that more than one device or article may be used in place of a single device or article. Similarly, where more than one device or article is described herein, it will be readily apparent that a single device or article may be used in place of the more than one device or article.

The functionality or the features of a device may be alternatively embodied by one or more other devices that are not explicitly described as having such functionality or features. Thus, other aspects need not include the device itself.

Techniques and mechanisms described or referenced herein will sometimes be described in singular form for clarity. However, it should be appreciated that particular aspects may include multiple iterations of a technique or multiple instantiations of a mechanism unless noted otherwise. Process descriptions or blocks in figures should be understood as representing modules, segments, or portions of code which include one or more executable instructions for implementing specific logical functions or steps in the process. Alternate implementations are included within the scope of various aspects in which, for example, functions may be executed out of order from that shown or discussed, including substantially concurrently or in reverse order, depending on the functionality involved, as would be understood by those having ordinary skill in the art.

DETAILED DESCRIPTION OF EXEMPLARY EMBODIMENTS AND ASPECTS

There will now be described, by way of example only, the best mode contemplated by the inventor for carrying out the present invention. In the following description, numerous specific details are set out in order to provide a complete understanding to the present invention. It will be apparent to those skilled in the art, that the present invention may be put into practice with variations of the specific.

Referring now to FIG. 6A, FIG. 6B, FIG. 7A, and FIG. 7B, relating to delivery bags being in accordance with a first embodiment of the invention and a proprietary delivery bag, Applicant has performed tests in a temperature-controlled chamber which operated at −10 C as indicated by the ambient traces FIG. 6A, FIG. 7A. The tests were performed with two similarly sized bags of dimensions 29 cm (w)×16 cm (g)×29 cm (h) (12"×7"×12"), being standard sized boxes over a period of twelve hours. The proprietary delivery bag is one which is presently employed by an internet delivery company. In each box insert 22, 32, 8×220 ml water bottles 40 were placed amounting to some 1.78 Kg at an initial temperature of +5° C.±3° C. After approximately 3 hours, the temperatures stabilized; Data relating to the temperature of the worst performing product position, together with data from a sensor on top of product being the air temperature and relative humidity are tabulated.

The bag in accordance with the present invention recorded a better performance for the first 7 hours of >10%, when comparing worst case product temperatures FIG. 6A, FIG. 6B. The MKT calculated for the 7-hour duration for the current proprietary delivery bag was −5.1° C., whilst the same results in respect of the present invention observed a 27.5% reduction at −3.7° C. It should also be noted that the paper version managed the humidity within the system better than the proprietary delivery bag FIG. 7A, FIG. 7B, keeping the relative humidity (RH) under 61.0% for the full duration of the test, compared to the prior system, where the relative humidity remained above 78% throughout the test procedure. The tests were performed using industry standard temperature data logger monitoring technology, namely a LogTag®, as produced by LogTag Recorders Ltd. It will be noted that the temperature monitor is packaged with the product and, having a thermal mass takes a period of time to register the correct temperature, given that the sensor is placed within and about the product. Effectively the present invention provides a delivery bag system that has a high insulation value by virtue of the fluting of the corrugated paper, together with the metallization, whereby transfer of heat is reduced with the humidity level being maintained to an acceptable level, without the need for gel sachets or other hygroscopic elements that would otherwise need to be used to prevent a potential spoilage of food and or labels of food.

Metallized paper is produced for numerous industries including food companies, brewers, spirit and water bottlers and the like. Metallized paper has been employed to provide products with a brilliant, high quality appearance and provides a look that can improve sales. However, in addition to this, not only can metallized paper provide a superior appearance, but metallized paper can also provide a beneficial thermal barrier, whereby food and drink produce can remain about a selected temperature for longer, to assist in products being cooler and fresher. Applicants have developed techniques whereby the paper used for the corrugate is metallized prior to corrugation—typically performed by two rollers having undulations in correspondence with the fluting requirement, as is known to those skilled in the art, as shall be discussed in further detail below.

It will be noted that in accordance with the first embodiment, the single face (single sided) corrugated board is presented with the flutes directed outwardly, so as to present a smooth internal surface to the box. The material is flexible in one direction (parallel to the flutes), stiff in the other direction (orthogonal to the flutes). By having the adhesive seal A3 from the cardboard cover attached to an outside flute upon fastening after filling of the bag 22 permits simpler—and potentially less stressful—unfastening at the time of delivery to a customer. It would, of course, be possible to present the material in an opposite fashion but it is believed that a smooth internal surface has a greater aesthetic appeal. By employing a single face cardboard, the sidewalls of the bag 22 separated by the gusset (also referred to as a dimension as depth) are sufficiently flexible to accommodate goods such a fashion. Whilst double sided corrugated cardboard could be used, it has been considered too rigid for most types of delivery, but it will be appreciated this could be viewed as a benefit for certain goods, where a rigid structure for enclosure of produce is required. The adhesive tape employed can be a plastics tape, but a paper tape, conveniently with cellulose glue, can alternatively be employed, to minimize any non-cellulose product in the recycle process.

Single sided corrugated board is also known as single face board but is not in widespread use to the same extent as double-sided board and is typically produced in reels with a re-winder either in the corrugator wet end line or as a specialist single facer group and re-winder off-line. The material is flexible in one direction, yet stiff in the other direction. Corrugated board is available in many different material grades with varying paper weights and finishes. Standard finishes include kraft (brown), white and mottled/oyster, LT (recycled paper) and Test (recycled inner liner). White papers can be coated to provide superior substrate for greater print quality. Standard paper thicknesses start at 125 gm-2 (grams per square meter) and increase to 150 gm-2, 200 gm-2 and 300 gm-2. Different flute weights are also available and depend on the strength of material required. Corrugated board has five common sizes of fluting, A, B, C, E and F, such designations being relevant only with regard to the date of first usage and not their relative size. A fluting has a diameter of 5 mm and provides a high top-to-bottom compression, with good staking strength; the thickness gives outstanding cushioning protection. B fluting has a diameter of 4 mm to give a very robust fluting, offering compactness for minimizing storage space and provides a good printing surface. C fluting has a diameter of 3 mm. This is a larger flute than B, offering greater compression strength, although the crush strength is not as strong as a smaller flute. E fluting has a diameter of 2 mm. This is a very fine flute for corrugated cartons. It gives an excellent crush resistance and compression strength. It also provides a high-quality print finish. F fluting has a diameter of 1 mm, which also provides a good crush resistance and compression strength. Applicants have found that C fluting provides a single sided board with good characteristics for the specific storage transport and delivery tasks. It will be appreciated that, in order to improve the R-value, one or more inside bags may be employed; they may adhesively be connected together.

In a further variation, a double sided (double faced) corrugated board could be utilized, of the type referred to a "oyster" board. In such an instance, an oyster variant of cardboard can be utilized, given the reduced weight translucent paper of the "oyster side" of the board is more easily folded. Equally specialized board having a comb-like profile could also be employed.

It is also useful to comment that once metallization has been performed, upon a paper/single sided corrugate etc., it is possible to safely print logos, branding, imagery, and text onto the metallized substrate, helping brands catch and retain consumer attention with innovative looks with an eco-friendly wrap. Such metallized finish can continue to look great even under the challenging scenarios that come with direct food contact, such as moisture build up and grease, for example. In addition to the technical properties offered by the metallized paper products when used for food bags, the papers are considered as a mono-material in that they are not considered as a metallized cellulose product as such but merely as a cellulose material and therefore they provide a recyclable alternative to traditionally treated metallized packaging that requires the use of metallized foils and films. Specifically, the metallizing process deposits an exceptionally thin vapor onto paper. Because the layer of aluminum on our metallized paper is so thin, being of the order of 5-15 um, it essentially means that the metal takes on the characteristics of paper, rather than changing the paper into a different material. Indeed, the paper and single sided fluted board has been treated so that it remains capable of passing the required aerobic biodegradability requirements in both Europe and the USA. Furthermore, the paper/card products have also been tested break down or re-pulp in nearly every recycling paper mill, whether using neutral pH or de-inking processes and to confirm that it causes no toxic effects to plant growth.

In a grocery drop-bag system, it is worth noting that the delivery companies tend to use more bags than is strictly necessary, arising from convenience and timing in the distribution and packing center, not only because it is sensible to maintain a separation between classes of good that are frozen, chilled, and ambient products but also packing areas in a distribution center will necessarily be separate. Additionally, certain classes of good may benefit from additional insulation and the use of cooling elements such as phase change materials, dry ice etc. Accordingly, two or more internal bags may be provided. Notwithstanding this, it will be appreciated that three or more separate compartments could be provided.

There are many types of corrugated sheet available; most corrugated sheet is cardboard, but plastics board is also available. Corrugated packaging is a versatile, economic, light, robust, recyclable, practical form of packaging and offers almost unlimited possible combinations of board types, flute sizes, paper weights, adhesive types, treatments, and coatings. Corrugated cellulose board is produced by combining various papers together in the form of paper layers. These layers are called liners and fluting (the fluting being formed to create a specific profile). The basic types of corrugated material have different material layers in its construction: Single face (two layers: one liner, one fluted); Single wall (three layers: two liners, one fluted). These liners and fluting once assembled give the overall structure better strength than that of each individual layer as the fluting provides a significant increase in rigidity to the structure of the container.

The structural strength of corrugated board is derived from the physical fluting of the corrugations, which are glued with paper board or extruded in the case of plastics board. It is important therefore to consider the flute direction and strength of fluting to use. Additional strength can be added by providing enhanced fluting although whilst strength is improved, heavier fluting can make the flute tips more rigid and thus affect the surface finish especially on large flute profiles—this can influence the appearance of any graphics that can be printed upon an external surface. Several types of flute are available: typically, single wall corrugated for outer containers will typically incorporate either: R, E, B or C flute.

Corrugated cellulose is a natural, environmentally friendly material with an unbeatable record for recycling and recovery. Corrugated cellulose is an extremely flexible medium that accommodates a wide range of printing options to fully support the end user requirements. Corrugated cellulose can coat to provide a hygroscopic wall, which is of advantage when a cold body increases in temperature and is liable to cause moisture within the enclosed atmosphere to condense; the excess condensation can be absorbed by the cellulose. Corrugated board is made from papers made up from cellulose fibers, which are virgin or recycled and offers almost unlimited possible combinations of board types, flute sizes, paper weights, adhesive types, treatments, and coatings. Most types of "cardboard" are recyclable.

A corrugator is machine used to manufacture corrugated material—cardboard and operate such that, in an initial step, reels of paper will be fed into the corrugator, where the paper is conditioned with heat and steam prior to being fed into the single facer, which is a section of the corrugator which, transforms the paper into the flute by creating a series of arched folds, determined by large rotating cylinders with a specified corrugated profile which creates the grooves in corrugated paper. By the use of starch or another suitable glue, which is applied to the tips of the flutes on one side, whereby to enable an inner liner to be fixed thereto is then affixed to the fluting—this is called a single web. By the use of starch or another suitable glue, which is applied to the tips of the flutes on one side, whereby to enable an inner liner to be fixed thereto is then affixed to the fluting—this is called a single web. For a double-sided cardboard, the procedure is repeated, with heat being applied to ensure that the bonds are strong, gelling the glue and removing moisture. It is important to note that the metallization can be performed prior to the corrugation on one or surfaces of the corrugated board.

Applicants have treated at least one surface of the inner bag and preferably the outer bag by the vacuum deposition of a metallic film—preferably aluminum given that a thin film of aluminum can serve as a good reflector (approximately 92%) of visible light and an excellent reflector (as much as 98%) of medium and far infrared radiation. A physical vapor deposition (PVD) employing a plasma being a gaseous environment where there are enough ions and electrons for there to be appreciable electrical conductivity in a vacuum or low-pressure environment is a widely available technique to provide metallization. Additional coatings of a micro plastics material could be applied to one or more of the surfaces of the corrugated material to provide a degree of water resistance; the level of plastics remaining sufficiently low to maintain a recyclable classification of the basic paper/card material.

With reference to FIG. 8, an exemplary corrugated board sample 81 is shown with first and second boards, 82, 83 having a number of square apertures (not shown in this side view) in the corrugated material 84, spacing the two board materials was made with 10×10 mm apertures spaced from each other by 5 mm whereby a weight reduction of 64% was realized for the insulation layer. These specific dimensions were selected so that thermal convection phenomena associated with the specific board design could be ignored in associated theoretical modelling, although this was later proven to be unnecessary. In theory, a uniform material with a thermal conductivity of 0.034 W·m−1·K−1, layered between two the reflective layers boards 82, 83 with an emissivity of 0.1, would drop to 0.029 W·m−1·K−1 with the opening described above resulting in a performance gain of 15%. Applicants have determined that measurements performed on single fluted corrugated cardboard showed encouraging results proving the design concept and the analytical solution. This material has been chosen due to its low price and widespread availability. The material conductivity went from 0.044 W·m−1·K−1 to 0.038 W·m−1·K−1.

For clarity, the following alternative designs have been ranked with the most desirable design first. However, this hierarchy is open to discussion and can be rearranged depending on various constraints such as feasibility, cost, and final structure's strength. All dimensions are set for their nominal values to increase thermal insulation's performance. These values are ideal and should be adapted depending on manufacturing capability and mechanical properties. The aperture—sheet material density ratio for a sample is the ratio of the area of the support material between the first and second outer surfaces to the corresponding area of said first outer surface (or second outer surface, since they are equal). It could also be expressed as a percentage indicating how much surface area the frame cover. Hence, the apertured sheet surface covering is 1−ρ. To achieve the highest thermal insulation, the aperture—sheet material density ratio ρ should be minimized reducing the thermal bridges. The material used as an insulator for the theoretical thermal conductivity value was single faced corrugated cardboard. FIG. 8A illustrates variations in conductivity at different temperatures. FIG. 8B shows a graph depicting conductivity versus gap size of an example in accordance with the invention.

FIG. 8C shows a first design of insulating sheet spacer having square apertures, with rounded corners, with the squares being arranged diagonally with respect to a flute direction as indicated with reference to FIG. 8I, with the sides being defined therein where apertures within the inside start winding portion side edge of a single sided corrugated winding. In a coiled product, the flutes of the corrugated material conveniently face inwardly, with a liner being employed when a box has been assembled.

Characteristic length $L_c = 40$ mm

Gap between adjacent apertures $d_{gap} = 7$ mm

Distance between aperture centers $d_{ip} = 47$ mm $$\text{Aperture-sheet material density ratio } \rho = \frac{d_{ip}^2 - L_c^2}{d_{ip}^2},\ \rho = 0.276$$

Theoretical conductivity value $\lambda_{hot} = 0.033\ \mathrm{W \cdot m^{-1} \cdot K^{-1}}$ FIG. 8D shows a second design of insulating sheet spacer having 20 mm radius hexagons (20 mm side length) separated from each other by a 7 mm gap. Each row was arranged so the diameter d parallel to the flute direction would fall midway with respect to a gap between two hexagons in adjacent rows, with the distance between two hexagon centers from the same row being 41.6 mm.

Characteristic length $L_c = 20$ mm

Gap between adjacent apertures $d_{gap} = 7$ mm

Distance between aperture centers $d_{ip} = 47$ mm $$\text{Aperture-sheet material density ratio } \rho = \frac{\left(L_c + \frac{d_{gap}}{2 \times \sin\frac{\pi}{3}}\right)^2 - L_c^2}{\left(L_c + \frac{d_{gap}}{2 \times \sin\frac{\pi}{3}}\right)^2},$$

$$\rho = 0.308$$

FIG. 8E shows a third design of insulating sheet spacer having square apertures of 40 mm, 3 mm radius rounded corners, having first and third parallel sides parallel to the flute direction and the other second and fourth sides being perpendicular to the flute direction.

Characteristic length $L_c = 40$ mm

Gap between adjacent apertures $d_{gap} = 7$ mm – parallel to flute

Gap between adjacent apertures $d_{ip} = 157$ mm – perpendicular to flute

Distance between aperture centers $d_{ip} = 47$ mm $$\text{Aperture-sheet material density} = \frac{(L_c + d_{gap}) \times (L_c + d_{gap}) - L_c^2}{(L_c + d_{gap}) \times (L_c + d_{gap})},$$

$$\rho = 0.381$$

FIG. 8F relates to fourth and fifth designs of insulating sheet spacer each having circular apertures of 20 mm diameter, with a separation of 7 mm. However, the alignment of the circles was arranged such that each row was shifted respectively by 47 and 117 mm respectively.

Fourth Design:

Characteristic length $L_c = 20$ mm radius

Gap between adjacent apertures $d_{gap} = 7$ mm

Distance between pattern centers $d_{ip} = 47$ mm $$\text{Aperture-sheet material density } \rho = \frac{d_{ip}^2 - \pi L_c^2}{d_{ip}^2},\ \rho = 0.431$$

Fifth Design: half shift between circles—per fifth design

Characteristic length $L_c = 115$ mm diameter

Gap between shape $d_{gap} = 20$ mm

Distance between pattern centers $d_{ip} = 47$ mm, $d_{ip} = 135$ mm $$\text{Void-matter density ratio } \rho = \frac{d_{ip}^2 - \pi L_c^2}{d_{ip}^2},\ \rho = 0.342$$

FIG. 8G relates to a sixth design of insulating sheet spacer comprising equilateral triangles with one side parallel to the flute and the others by 60° to the flute, the base length being 40 mm and the spacing between triangles being spaced by a 7 mm gap between their respective sides.

Characteristic length $L_c = 40$ mm

Gap between adjacent apertures $d_{gap} = 7$ mm – perpendicular to flute

Distance between aperture centers $d_{ip} = 28.08$ mm

Aperture-sheet material density $$\frac{\left(\frac{L_c}{2} + \frac{2\sqrt{3}}{3} \times d_{gap}\right) \times \left(\frac{\sqrt{3}}{2} L_c + d_{gap}\right) - \frac{\sqrt{3}}{4} L_c^2}{\left(\frac{L_c}{2} + \frac{2\sqrt{3}}{3} \times d_{gap}\right) \times \left(\frac{\sqrt{3}}{2} L_c + d_{gap}\right)}, \rho = 0.985$$

FIG. 8H relates to a further embodiment; rather than cutting apertures in corrugated paper, strips of corrugated paper 810 are provided, where the strips are cut at 45° to the flute direction and are mounted with respect to cardboard/paperboard 811, with the strips 810 of corrugate paper each arranged at sheets at 45° to an axis of the cardboard/paperboard.

FIG. 9, FIG. 10, and FIG. 11 comprise tables relating, respectively, to density, thermal conductivity, and specific heat capacity of a number of exemplary models. It will be appreciated, that the techniques for forming the corrugated inner bag material could be applied to the outside bag, to further assist in heat retention.

It is known that plastics can be "up-cycled" to longer chain carbon compounds. Furthermore, plastics can be broken down to provide fuels and, if properly categorized, plastics can be recycled, which is also of benefit in that many packaging solutions employ plastics. For example, corrugated plastics are generally provided in the form of extruded polypropylene, whereby to provide a lightweight, rigid plastic sheet that is easy to handle. Polypropylene can be simply printed upon using standard techniques and so an external face of a corrugated carton can provide information and/or bear advertisement for a supplier etc. Polypropylene sheets are generally produced without coloring and will have a white and opaque exterior surface, but pigments can readily be added. Polypropylene has good chemical inertness and good resistance to cracking under stress, is considered as being inert and there are no widely available solvents operable at 20° C. Furthermore, polypropylene is very resistant to mineral and organic products and is neither affected by water solutions of mineral salts, nor by chemical bases and mineral acids at temperatures lower than 60° C., except very strong acids. However, it is not resistant to substances with an oxidizing effect or to certain solvents at elevated temperatures.

By the use of polypropylene for the manufacture of corrugated board, a number of recycling opportunities are available. Polypropylene can be thermally recovered (incinerated) where the heat produced can then be used as substitutes for oil, gas and coal or to generate energy at power plants. The complete combustion of polypropylene with air only produces carbon dioxide and water. At higher temperatures traces of nitrogen oxide can be generated, whilst the incomplete combustion of polypropylene produces soot, carbon dioxide and monoxide, and several carbon, hydrogen, and oxygen compounds. Such unburned by-products are also released during the combustion of natural materials such as wood or wool. Polypropylene wastes can easily be recycled by way of mechanical recycling, where waste product is collected, cleaned/separated, milled, melted, and extruded in granules in order to be re-injected in other manufacturing processes.

The skilled person will be aware of a range of possible modifications of the various aspects described above. Accordingly, the present invention is defined by the claims and their equivalents.

What is claimed is:

1. The improved container for storage and transportation of goods, the container comprising: an outer container, comprising: a cellulose fiber bag-like element having a base, an upstanding circumferential wall, wherein an upper edge of the wall defines a closable opening to volume-adjustable storage compartment defined by the inside faces of the circumferential wall and base, and; an inner container, comprising: a cellulose fiber bag-like element having a base, an upstanding circumferential wall, wherein the inner container is formed from at least single-sided corrugate sheet material, and at least one surface of the corrugate sheet material has a metallic thin-film coating.

2. The improved container for the storage and transportation of goods according to claim 1, wherein the single-sided corrugate sheet material is formed from a fluted sheet material and a planar sheet material, each having an inner face and an outer face, wherein at least one inner face is provided with a thin film metallic coating.

3. The improved container for the storage and transportation of goods according to claim 1, wherein the metallic thin-film coating is formed from aluminum.

4. The improved container for the storage and transportation of goods according to claim 1, wherein the metallic thin-film coating is applied such that the recyclability of the cellulose fiber product is not diminished by the amount of metal present.

5. The improved container for the storage and transportation of goods according to claim 1, wherein the metallic thin-film coating is applied by vacuum deposition techniques.

6. The improved container for the storage and transportation of goods according to claim 1, wherein the wherein corrugated material of the single-sided corrugate sheet material, is apertured.

7. The improved container for the storage and transportation of goods according to claim 6, wherein the apertures of the corrugated material are formed in at least one shape selected from the group of square, rectangular, round, oval, triangular, polygonal, and combinations thereof.

8. The improved container for the storage and transportation of goods according to claim 1, wherein the wherein corrugated material is cut into lengths and arranged in a spaced side-by-side relationship.

9. The improved container for the storage and transportation of goods according to claim 1, wherein the outer container includes an adhesive tab operable to attach an upper edge element of a first side of the container to an opposite facing, second side of the container, whereby to close the outer container.

10. The improved container for the storage and transportation of goods according to claim 1, wherein the outer container includes a fastener element upon an upper edge element of a first side operable to attach to a corresponding fastener element on an opposite facing, second side of the container, whereby to close the outer container.

11. The improved container for the storage and transportation of goods according to claim 1, wherein the inner container includes an adhesive tab operable to attach an upper edge element of a first side of the inner container to an opposite facing, second side of the inner container, whereby to close the inner container.

12. The improved container for the storage and transportation of goods according to claim 1, wherein the inner container includes a fastener element upon an upper edge element of a first side operable to attach to a corresponding fastener element on an opposite facing, second side of the container, whereby to close the inner container.

13. The improved container for the storage and transportation of goods according to claim 1, wherein at least one of the inner and outer containers is formed from kraft paper sheet.

14. The improved container for the storage and transportation of goods according to claim 1, wherein at least one of the inner and outer containers is formed from cellulose paper sheet.

15. The improved container for the storage and transportation of goods according to claim 1, wherein at least one of the inner and outer containers is a composite sheet material formed from paper and plastics fiber.

16. The improved container for the storage and transportation of goods according to claim 1, wherein the corrugated sheet is cellulose-based and wherein the layers of sheet and fluted corrugations are glued or otherwise connected to each other.

17. The improved container for the storage and transportation of goods according to claim 1, further comprising one or more temperature control packs for placement within the inner container.

18. The improved container for the storage and transportation of goods according to claim 17, wherein the temperature control packs include phase change materials contained in sealed containers.

19. The improved container for the storage and transportation of goods according to claim 1, further comprising one or more temperature control packs for placement within the outer container and outside the inner container.

20. The improved container for the storage and transportation of goods according to claim 19, wherein the temperature control packs include phase change materials contained in sealed containers.

* * * * *